US010711654B2

(12) United States Patent
Hisaeda et al.

(10) Patent No.: US 10,711,654 B2
(45) Date of Patent: Jul. 14, 2020

(54) VALVE TIMING CONTROLLER

(71) Applicant: AISIN SEIKI KABUSHIKI KAISHA, Kariya-shi, Aichi-ken (JP)

(72) Inventors: Yusuke Hisaeda, Kariya (JP); Takeo Asahi, Kariya (JP); Hideyuki Suganuma, Anjo (JP); Tomohiro Kajita, Anjo (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 16/256,294

(22) Filed: Jan. 24, 2019

(65) Prior Publication Data

US 2019/0234244 A1 Aug. 1, 2019

(30) Foreign Application Priority Data

Jan. 31, 2018 (JP) ..... 2018-015841
May 23, 2018 (JP) ..... 2018-099094

(51) Int. Cl.
*F01L 1/344* (2006.01)
*F01L 1/02* (2006.01)
(Continued)

(52) U.S. Cl.
CPC ..... *F01L 1/02* (2013.01); *F01L 1/022* (2013.01); *F01L 1/3442* (2013.01);
(Continued)

(58) Field of Classification Search
CPC ..... F01L 1/02; F01L 1/047; F01L 1/46; F01L 2001/344; F01L 2001/34433;
(Continued)

(56) References Cited

U.S. PATENT DOCUMENTS 7,946,266 B2 5/2011 Knecht et al.
9,803,520 B2 10/2017 Smith et al.
(Continued)

FOREIGN PATENT DOCUMENTS

JP 2009-530526 A 8/2009
JP 2012-207671 A 10/2012
(Continued)

*Primary Examiner* — Devon C Kramer
*Assistant Examiner* — Kelsey L Stanek
(74) *Attorney, Agent, or Firm* — Buchanan Ingersoll & Rooney PC

(57) ABSTRACT

A valve timing controller includes: a driving side rotation member synchronously rotating with a crankshaft of an internal combustion engine; a driven side rotation member disposed coaxially with a rotary shaft center of the driving side rotation member and rotating integrally with a valve opening/closing cam shaft; advancing and retarding chambers formed between the driving side and driven side rotation members; a valve unit disposed coaxially with the rotary shaft center and controlling feeding and discharging of a fluid to and from the advancing and retarding chambers; and a tubular valve case having an internal space extending in a direction along the rotary shaft center, accommodating the valve unit in the internal space, having an opening at one end in the direction along the rotary shaft center, and having a bottom portion at the other end.

14 Claims, 19 Drawing Sheets

(51) Int. Cl.
*F01L 1/047* (2006.01)
*F02D 41/00* (2006.01)

(52) U.S. Cl.
CPC ..... *F01L 2001/0476* (2013.01); *F01L 2001/3443* (2013.01); *F01L 2001/3444* (2013.01); *F01L 2001/34426* (2013.01); *F01L 2001/34433* (2013.01); *F01L 2001/34469* (2013.01); *F01L 2001/34483* (2013.01); *F01L 2810/04* (2013.01); *F01L 2820/032* (2013.01); *F02D 2041/001* (2013.01)

(58) Field of Classification Search
CPC ..... F01L 2001/34426; F01L 2001/3445; F01L 2001/34469; F01L 2820/032; F01L 1/344; F01L 1/3443; F01L 2001/3443; F01L 2001/34483; F01L 2001/3444; F01L 2001/0476; F02D 2041/001
USPC ..... 123/90.15, 90.17, 90.16
See application file for complete search history.

(56) References Cited

U.S. PATENT DOCUMENTS

| | | | | |
|---|---|---|---|---|
| 2017/0058726 | A1* | 3/2017 | Smith | F01L 1/34409 |
| 2017/0058727 | A1* | 3/2017 | Smith | F01L 1/34409 |
| 2018/0135471 | A1* | 5/2018 | Kajita | F01L 1/047 |
| 2018/0245488 | A1* | 8/2018 | Hamasaki | F15B 13/0402 |
| 2018/0363514 | A1* | 12/2018 | Stanhope | F01L 1/3442 |

FOREIGN PATENT DOCUMENTS

| | | | |
|---|---|---|---|
| JP | 2017-048793 | A | 3/2017 |
| JP | 2018-080593 | A | 5/2018 |

* cited by examiner

VALVE TIMING CONTROLLER

CROSS REFERENCE TO RELATED APPLICATIONS

This application is based on and claims priority under 35 U.S.C. § 119 to Japanese Patent Applications 2018-015841 and 2018-099094, filed on Jan. 31, 2018 and May 23, 2018, respectively, the entire contents of which are incorporated herein by reference.

TECHNICAL FIELD

This disclosure relates to a valve timing controller.

BACKGROUND DISCUSSION

JP 2009-530526T (Reference 1) discloses a vehicle hydraulic circuit with a motor including a hydraulic piston including at least two cylinder chambers (advancing chamber and retarding chamber) that act in mutually opposite directions, configured such that an external force acts alternately or in one direction in the cylinder chamber, the hydraulic piston is moved by a differential pressure between the cylinder chambers, and the differential pressure is generated from a hydraulic source, such as a hydraulic pump. The hydraulic circuit is used for a cam shaft timing adjuster (valve timing controller) and uses a hydraulic load by a force that acts on a negative side caused by opening at least one check valve among the alternating external forces in addition to the hydraulic load by a changeover device for the movement of the hydraulic piston.

In the valve timing controller described in Reference 1, the check valves are provided in return passages of hydraulic oil from cylinder chambers that act in mutually opposite directions, and a downstream side of the check valve is connected to a pressure supply pipe for supplying the hydraulic oil to the cylinder chamber. The valve timing controller realizes the circulation of the hydraulic oil from one cylinder chamber to the other cylinder chamber by providing the check valve, and it is possible to quickly move the hydraulic oil to the cylinder chamber.

JP 2017-048793A (Reference 2) describes a variable camshaft timing device (valve timing controller) can operate with the pressure generated by camshaft torque energy for transmitting a fluid from one working chamber to the other working chamber, can operate through a pressure source of an external fluid so as to discharge the contents in opposing working chambers at the same time when filling one working chamber, and can operate using both modes simultaneously.

In the valve timing controller described in Reference 2, the control valve is a spool valve having a spool, the spool has a cylindrical land that is slidably accommodated in a sleeve inside a bore of a center bolt, and the sleeve has a recess portion that connects the plurality of ports to each other. The spool of the valve timing controller is configured to have a central passage, and to be divided into a working central passage and an inlet central passage by a recirculating check valve and an inlet check valve provided in the central passage. The valve timing controller can reduce the package size of the valve timing controller by providing the recirculating check valve in the central passage.

In the valve timing controller described in Reference 1, since corresponding check valves are respectively required for each cylinder chamber (advancing chamber and retarding chamber) that act in mutually opposite directions, there is a problem because the structure becomes complicated. In the valve timing controller described in Reference 2, since the check valve (recirculating check valve and inlet check valve) is disposed inside the spool, the structure becomes complicated. In addition, since the check valve is disposed in a narrow space inside the spool, due to the restriction of the space, it is inconvenient that the size or the shape of the check valve is restricted.

Thus, a need exists for a valve timing controller which is not susceptible to the drawback mentioned above.

SUMMARY

A feature of a valve timing controller according to an aspect of this disclosure resides in that the valve timing controller includes: a driving side rotation member that synchronously rotates with a crankshaft of an internal combustion engine; a driven side rotation member which is disposed coaxially with a rotary shaft center of the driving side rotation member and rotates integrally with a valve opening/closing cam shaft; an advancing chamber and a retarding chamber which are formed between the driving side rotation member and the driven side rotation member; a valve unit that is disposed coaxially with the rotary shaft center and controls feeding and discharging of a fluid to and from the advancing chamber and the retarding chamber; and a tubular valve case which has an internal space that extends in a direction along the rotary shaft center, accommodates the valve unit in the internal space, has an opening that is open to an outside at one end in the direction along the rotary shaft center, and has a bottom portion at the other end, in which the valve unit includes a fluid supply pipe having a base end portion accommodated on a bottom portion side of the internal space and a pipeline portion that extends along the rotary shaft center from the base end portion toward the opening side has a diameter smaller than that of the base end portion and has a bottom surface, and a spool which is disposed slidably in the direction along the rotary shaft center in a state of being guided on an inner peripheral surface of the valve case and an outer peripheral surface of the pipeline portion of the fluid supply pipe, in which the valve case includes an advancing port and a retarding port which are formed across the internal space from the outer peripheral surface and respectively communicate with the advancing chamber and the retarding chamber, in which the spool includes a plurality of land portions formed at an outer periphery, and an intermediate hole portion that is formed in an intermediate position of a pair of adjacent land portions and capable of communicating with the advancing port or the retarding port from an inside by sliding movement of the spool, in which the fluid supply pipe includes a supply port that is provided at an outer periphery of a distal end portion of the pipeline portion and supplies the fluid from an inside to the intermediate hole portion, and receives the supply of the fluid from the other side of the base end portion to the pipeline portion, and in which the valve case has a first check valve that is provided on the bottom portion side of the valve case, and allows at least a part of the fluid discharged from the advancing chamber or the retarding chamber to a space between the valve case and the spool to flow from the space to a space further on the bottom portion side than on the base end portion side in the internal space.

According to the configuration, the spool is disposed in the internal space (hereinafter, there is a case of being referred to as an opening side internal space) on the opening side of the valve case when viewed from the base end portion of the fluid supply pipe, and the fluid discharged from the advancing chamber or the retarding chamber is discharged to the space between the valve case and the spool, that is, the internal space on the opening side of the valve case when viewed from the base end portion of the fluid supply pipe.

Further, according to the configuration, the valve case can return the fluid discharged to the space between the valve case and the spool from one of the advancing chamber and the retarding chamber to the space further on the bottom portion side than on the base end portion side in the internal space while preventing from flowing backward via the first check valve.

Here, since the fluid supply pipe receives the supply of the fluid to be supplied to the advancing chamber or the retarding chamber from the space (hereinafter, there is a case of being referred to as a bottom portion side space) on the bottom portion side of the base end portion to the pipeline portion, the fluid can be supplied to the other one of the advancing chamber and the retarding chamber by allowing the liquid discharged from one of the advancing chamber and the retarding chamber as described above to return to the bottom portion side space, that is, to circulate. Therefore, it is possible to sufficiently supply the fluid to the fluid supply pipe. As a result, it is possible to switch the valve opening/closing timing by quickly displacing the relative phase of the driven side rotation member in the advancing direction or the retarding direction.

In particular, in a case where the relative rotation phase of the driven side rotation member can be displaced in the advancing direction or the retarding direction by using the rotational energy (so-called cam torque) transmitted from the cam shaft, it is possible to displace the relative phase of the driven side rotation member in the advancing direction or the retarding direction and to switch the valve opening/closing timing while avoiding insufficient supply of the fluid.

A feature of a valve timing controller according to another aspect of this disclosure resides in that the valve timing controller includes: a driving side rotation member that synchronously rotates with a crankshaft of an internal combustion engine; a driven side rotation member which is disposed coaxially with a rotary shaft center of the driving side rotation member and rotates integrally with a valve opening/closing cam shaft; an advancing chamber and a retarding chamber which are formed between the driving side rotation member and the driven side rotation member; a valve unit that is disposed coaxially with the rotary shaft center and controls feeding and discharging of a fluid to and from the advancing chamber and the retarding chamber; and a valve case in which an internal space is formed in a direction along the rotary shaft center across the cam shaft from an outside, in which the valve unit is accommodated in the internal space, in which the valve unit includes a fluid supply pipe having a base end portion fitted into a cam shaft side in the internal space and a pipeline portion that extends from the base end portion toward an external side in the internal space and has a diameter smaller than that of the base end portion, and a spool which is disposed slidably in a direction along the rotary shaft center in a state of being guided on an inner peripheral surface of the valve case and an outer peripheral surface of the pipeline portion of the fluid supply pipe, in which the valve case includes an advancing port and a retarding port which are formed across the internal space from the outer peripheral surface and respectively communicate with the advancing chamber and the retarding chamber, in which the spool includes a pair of land portions formed at an outer periphery, and an intermediate hole portion that is formed in an intermediate position of a pair of land portions and capable of communicating with the advancing port or the retarding port from an inside by sliding movement of the spool, in which the fluid supply pipe receives the supply of the fluid from the cam shaft side of the base end portion to the pipeline portion, and in which the fluid supply pipe includes a supply port that is provided at an outer periphery of a distal end portion of the pipeline portion and supplies the liquid from an inside to the intermediate hole portion, and a first check valve that is provided in the base end portion and allows at least a part of the fluid discharged from the advancing chamber or the retarding chamber to a space between the valve case and the spool to flow from the external side of the base end portion to the cam shaft side.

According to the configuration, the spool is disposed in the internal space (hereinafter, there is a case of being referred to as an external side internal space) on the external side of the valve case when viewed from the base end portion of the fluid supply pipe, and the fluid discharged from the advancing chamber or the retarding chamber is discharged to the space between the valve case and the spool, that is, the internal space on the external side of the valve case when viewed from the base end portion of the fluid supply pipe.

Further, according to the configuration, in the base end portion of the fluid supply pipe, the first check valve that allows the fluid to flow from the external side to the cam shaft side, that is, the first check valve that allows the fluid to circulate from the external side to the cam shaft side and blocks the circulation of the fluid from the cam shaft side to the external side, is provided. Accordingly, it is possible to return the fluid discharged from one of the advancing chamber and the retarding chamber to the cam shaft side of the internal space of the valve case when viewed from the base end portion while preventing the fluid from flowing backward via the first check valve provided in the base end portion.

Here, since the fluid supply pipe receives the supply of the fluid to be supplied to the advancing chamber or the retarding chamber from the space (hereinafter, there is a case of being referred to as a cam shaft side space) on the cam shaft side of the base end portion to the pipeline portion, the fluid can be supplied to the other one of the advancing chamber and the retarding chamber by allowing the liquid discharged from one of the advancing chamber and the retarding chamber as described above to return to the cam shaft side of the valve case when viewed from the base end portion, that is, to circulate. Therefore, it is possible to sufficiently supply the fluid to the fluid supply pipe. As a result, it is possible to switch the valve opening/closing timing by quickly displacing the relative phase of the driven side rotation member in the advancing direction or the retarding direction.

In particular, in a case where the relative rotation phase of the driven side rotation member can be displaced in the advancing direction or the retarding direction by using the rotational energy (so-called cam torque) transmitted from the cam shaft, it is possible to quickly displace the relative phase of the driven side rotation member in the advancing direction or the retarding direction and to switch the valve opening/closing timing while avoiding insufficient supply of the fluid.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, a specific example of a valve timing controller according to embodiments disclosed here will be described with reference to FIGS. 1 to 21.

First Embodiment

Hereinafter, a first embodiment of the valve timing controller according to the disclosure will be described with reference to FIGS. 1 to 8.

Basic Configuration

Figure 1:
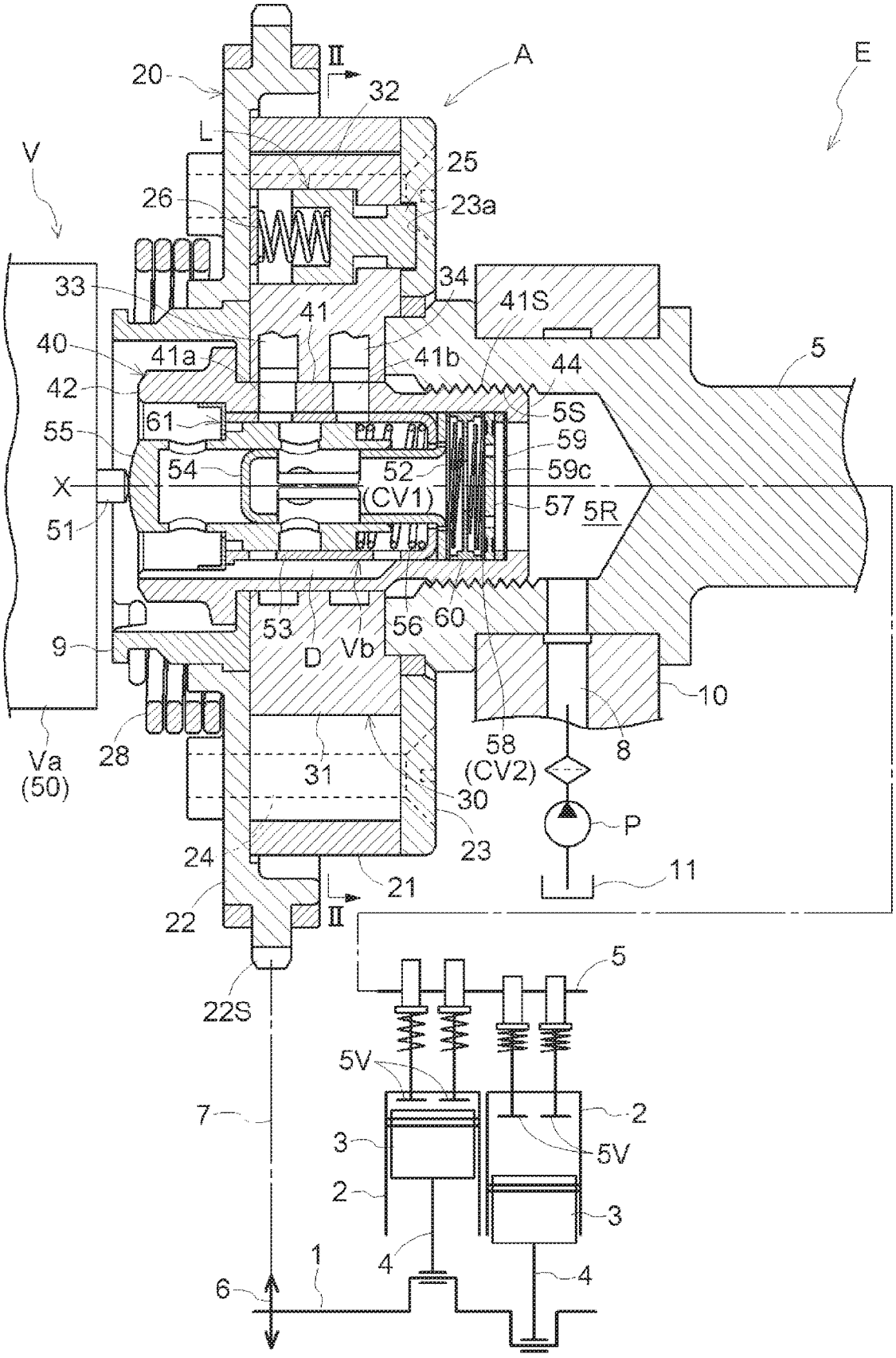
FIG. 1 is a sectional view illustrating the overall configuration of a valve timing controller.
Figure 2:
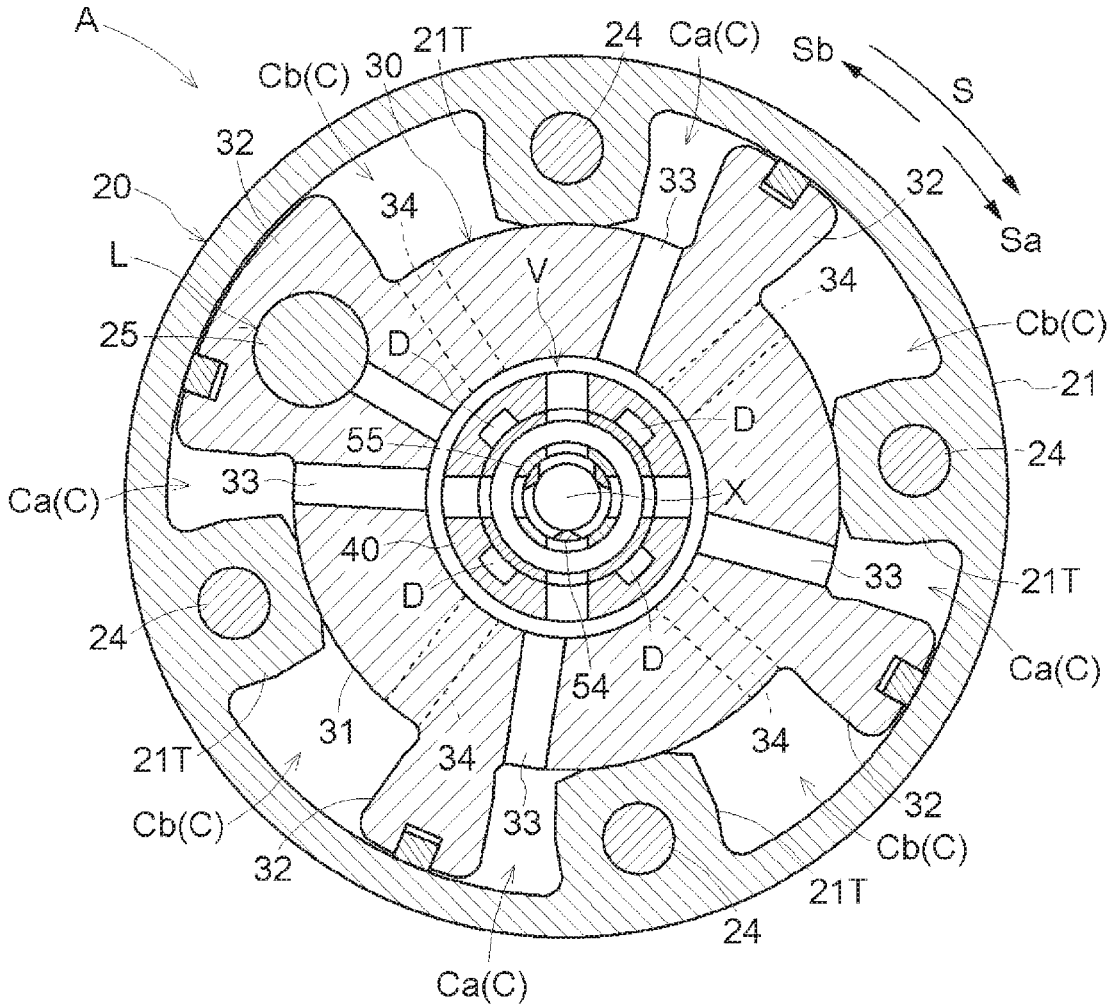
FIG. 2 is a sectional view taken along line II-II of FIG. 1.
Figure 3:
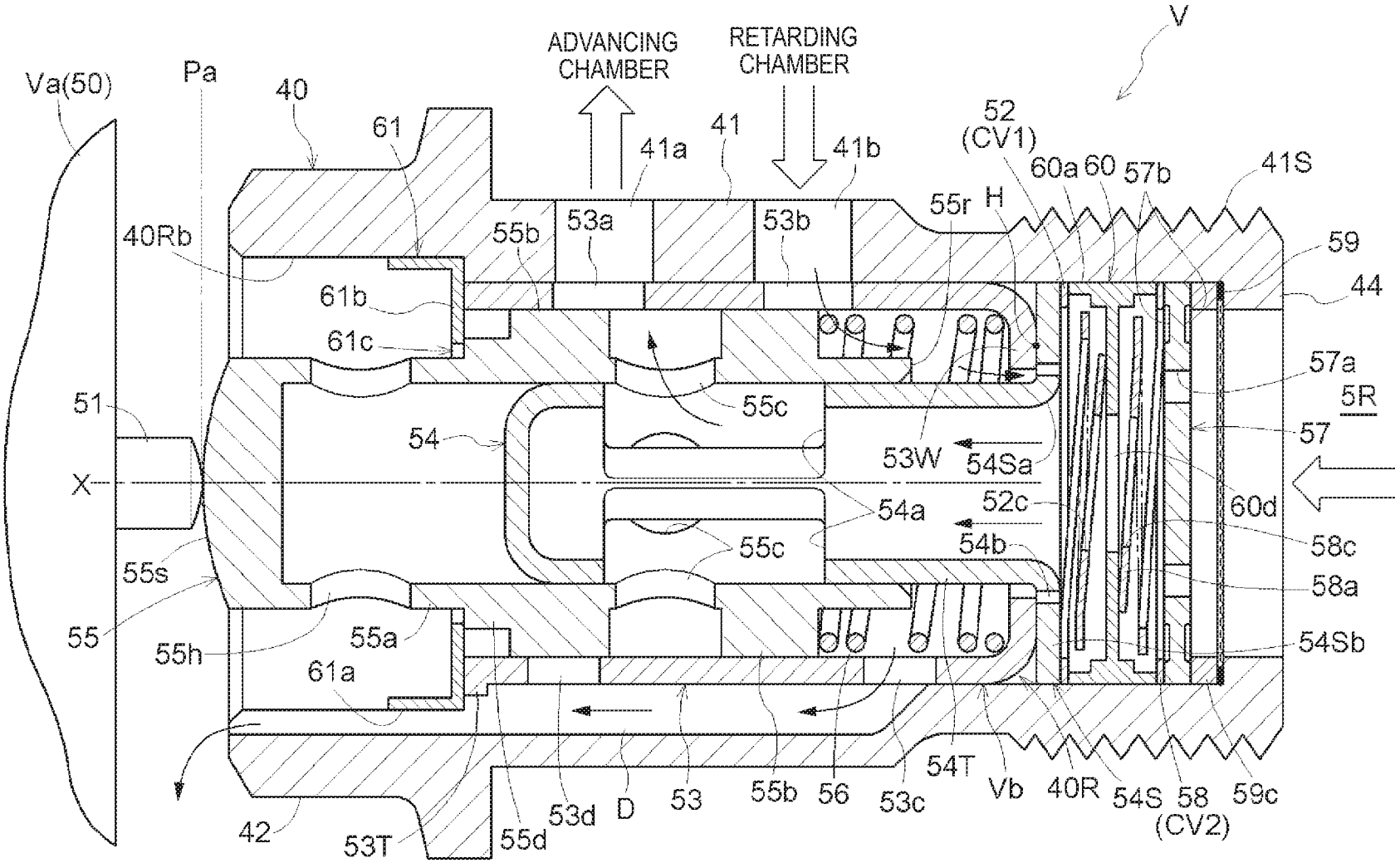
FIG. 3 is a sectional view of a valve unit in which a spool is in an advancing position.

As illustrated in FIGS. 1 to 3, a valve timing controller A including an external rotor 20 that serves as a driving side rotation member, an internal rotor 30 that serves as a driven side rotation member, and an electromagnetic control valve V that controls hydraulic oil that serves as a working fluid, is configured.

The internal rotor 30 (an example of the driven side rotation member) is disposed coaxially with a rotary shaft center X of an intake cam shaft 5, and is connected to the intake cam shaft 5 by a connecting bolt 40 (an example of a valve case) so as to rotate integrally with the intake cam shaft 5. The external rotor 20 (an example of the driving side rotation member) is disposed coaxially with the rotary shaft center X, and synchronously rotates with a crankshaft 1 of an engine E that serves as an internal combustion engine. The external rotor 20 includes the internal rotor 30, and the external rotor 20 and the internal rotor 30 are supported so as to be relatively rotatable.

The electromagnetic control valve V includes an electromagnetic unit Va supported by the engine E and a valve unit Vb accommodated in an internal space 40R of the connecting bolt 40.

The electromagnetic unit Va includes a solenoid portion 50 and a plunger 51. The plunger 51 is disposed coaxially with the rotary shaft center X so as to move back and forth by drive control of the solenoid portion 50. In the valve unit Vb, a spool 55 for controlling feeding and discharging of the hydraulic oil (an example of the fluid) is disposed coaxially with the rotary shaft center X.

According to the configuration, a protrusion amount of the plunger 51 is set under the control of electric power to be supplied to the solenoid portion 50, and in conjunction with this, the spool 55 is operated in a direction along the rotary shaft center X. As a result, the hydraulic oil is controlled by the spool 55, the relative rotation phase between the external rotor 20 and the internal rotor 30 is determined, and the control of the opening and closing timing of the intake valve 5V is realized. The configuration of the electromagnetic control valve V and the control aspect of the hydraulic oil will be described later.

Engine and Valve Timing Controller

The engine E (an example of the internal combustion engine) illustrated in FIG. 1 is illustrated to be provided in a vehicle, such as a passenger car. The engine E is configured in a four-cycle type in which a piston 3 is accommodated in a cylinder bore of a cylinder block 2 at an upper position and the piston 3 and the crankshaft 1 are connected to each other by a connecting rod 4. In an upper portion of the engine E, the intake cam shaft 5 for opening and closing the intake valve 5V and an exhaust cam shaft (not illustrated) are provided.

A supply flow passage 8 through which the hydraulic oil is supplied from a hydraulic pump P driven by the engine E is formed in an engine configuration member 10 that rotatably supports the intake cam shaft 5. The hydraulic pump P supplies lubricating oil stored in an oil pan 11 of the engine E to the electromagnetic control valve V as the hydraulic oil (an example of the fluid) via the supply flow passage 8.

A timing chain 7 is wound around an output sprocket 6 formed in the crankshaft 1 of the engine E and a timing sprocket 22S of the external rotor 20. Accordingly, the external rotor 20 synchronously rotates with crankshaft 1. In addition, the sprocket is also provided at a front end of the exhaust cam shaft on the exhaust side, and the timing chain 7 is also wound around the sprocket.

As illustrated in FIG. 2, the external rotor 20 rotates in a driving rotational direction S by a driving force from the crankshaft 1. A direction in which the internal rotor 30 relatively rotates in a direction the same as the driving rotational direction S with respect to the external rotor 20 is referred to as an advancing direction Sa, and a direction opposite thereto is referred to as a retarding direction Sb. In the valve timing controller A, a relationship between the crankshaft 1 and the intake cam shaft 5 is set such that an intake compression ratio increases as the displacement amount increases when the relative rotation phase is displaced in the advancing direction Sa, and the intake compression ratio decreases as the displacement amount increases when the relative rotation phase is displaced in the retarding direction Sb.

In addition, in the embodiment, the valve timing controller A provided in the intake cam shaft 5 is illustrated, but the valve timing controller A may be provided in the exhaust cam shaft. In addition, the valve timing controller A may be provided in both the intake cam shaft 5 and the exhaust cam shaft.

As illustrated in FIGS. 1 and 2, the external rotor 20 includes an external rotor main body 21, a front plate 22, and a rear plate 23, which are integrated by fastening a plurality of fastening bolts 24. The timing sprocket 22S is formed at the outer periphery of the front plate 22. In addition, an annular member 9 is fitted into the inner periphery of the front plate 22, and a bolt head portion 42 of the connecting bolt 40 is pressed against the annular member 9, and accordingly, the annular member 9, an internal rotor main body 31, the intake cam shaft 5 are integrated with each other.

External Rotor and Internal Rotor

As illustrated in FIG. 2, a plurality of protrusion portions 21T which protrude radially inward are integrally formed in the external rotor main body 21. The internal rotor 30 includes a columnar internal rotor main body 31 that is in tight contact with the protrusion portion 21T of the external rotor main body 21 and four vane portions 32 that protrude radially outward from the outer periphery of the internal rotor main body 31 so as to come into contact with the inner peripheral surface of the external rotor main body 21.

The external rotor 20 includes the internal rotor 30 in this manner, a plurality of fluid pressure chambers C are formed on the outer peripheral side of the internal rotor main body 31 in an intermediate position of the protrusion portions 21T adjacent to each other in the rotational direction, and as the fluid pressure chambers C are divided by the vane portion 32, an advancing chamber Ca and a retarding chamber Cb are formed to be divided. Furthermore, in the internal rotor 30, an advancing flow passage 33 that communicates with the advancing chamber Ca and a retarding flow passage 34 that communicates with the retarding chamber Cb are formed.

As illustrated in FIGS. 1 and 2, a torsion spring 28 that assists displacement of a relative rotation phase (hereinafter, referred to as a relative rotation phase) between the external rotor 20 and the internal rotor 30 from the most retarding phase in the advancing direction Sa by applying a biasing force in the advancing direction Sa, is provided across the external rotor 20 and the annular member 9.

As illustrated in FIGS. 1 and 2, in the valve timing controller A, a locking mechanism L for holding the relative rotation phase between the external rotor 20 and the internal rotor 30 in the most retarding phase is provided. The locking mechanism L includes a lock member 25 that is supported to freely move back and forth in the direction along the rotary shaft center X with respect to one vane portion 32, a lock spring 26 that protrudes and biases the lock member 25, and a lock recess portion 23*a* formed on the rear plate 23. In addition, the locking mechanism L may be configured by guiding the lock member 25 so as to move along the radial direction.

In a case where the phase rotation phase reaches the most retarding phase, the locking mechanism L reaches a locked state where the lock member 25 is engaged with the lock recess portion 23*a* by the biasing force of the lock spring 26. In addition, the locking mechanism L is unlocked by applying the pressure of the hydraulic oil that acts on the advancing flow passage 33 to the lock member 25 in an unlocking direction.

Connecting Bolt

As illustrated in FIGS. 3 to 6, the connecting bolt 40 has a bolt head portion 42 formed in the outer end portion (the side opposing the electromagnetic unit Va) of the bolt main body 41 which is tubular as a whole. Further, a male screw portion 41S (an example of a screw portion) is formed at the outer periphery at the other end part from the bolt head portion 42 in the bolt main body 41.

A cylindrical internal space 40R that penetrates the inside of the connecting bolt 40 in the direction along the rotary shaft center X is formed. Accordingly, the connecting bolt 40 can accommodate the valve unit Vb in the internal space 40R as a valve case.

Hereinafter, in a case of describing the direction or relative position relation of each portion of the valve timing controller A, there is a case where the side of the male screw portion 41S of the bolt main body 41 in the direction along the rotary shaft center X, that is, the intake cam shaft 5 side, is referred to as the screw portion side. In addition, there is a case where the side of the bolt head portion 42 of the bolt main body 41 in the direction along the rotary shaft center X, that is, the side opposing the electromagnetic unit Va which is the other end side of the intake cam shaft 5 side via the connecting bolt 40 is referred to as a head portion side. In addition, the screw portion side and the head portion side respectively correspond to the upstream side and the downstream side in a circulating direction of the hydraulic oil to be supplied via the supply flow passage 8.

When describing based on the configuration of the connecting bolt 40, the screw portion side (upstream side) and the head portion side (downstream side) correspond to the side of a large-diameter portion 40Rb to be described later and the side on which a restriction wall 44 is provided.

As illustrated in FIG. 1, in the intake cam shaft 5, an in-shaft space 5R centering around the rotary shaft center X is formed, and a female screw portion 5S is formed at the inner periphery of the in-shaft space 5R. The in-shaft space 5R communicates with the above-described supply flow passage 8.

With the configuration, in a state where the bolt main body 41 is inserted into the annular member 9, the external rotor 20, and the internal rotor 30, the male screw portion 41S is screwed into the female screw portion 5S of the intake cam shaft 5, and by rotating the bolt head portion 42, the internal rotor 30 is fastened to the intake cam shaft 5. By the fastening, the annular member 9 and the internal rotor 30 are fixed to the intake cam shaft 5, and the in-shaft space 5R and the connecting bolt 40 communicate with each other.

Figure 4:
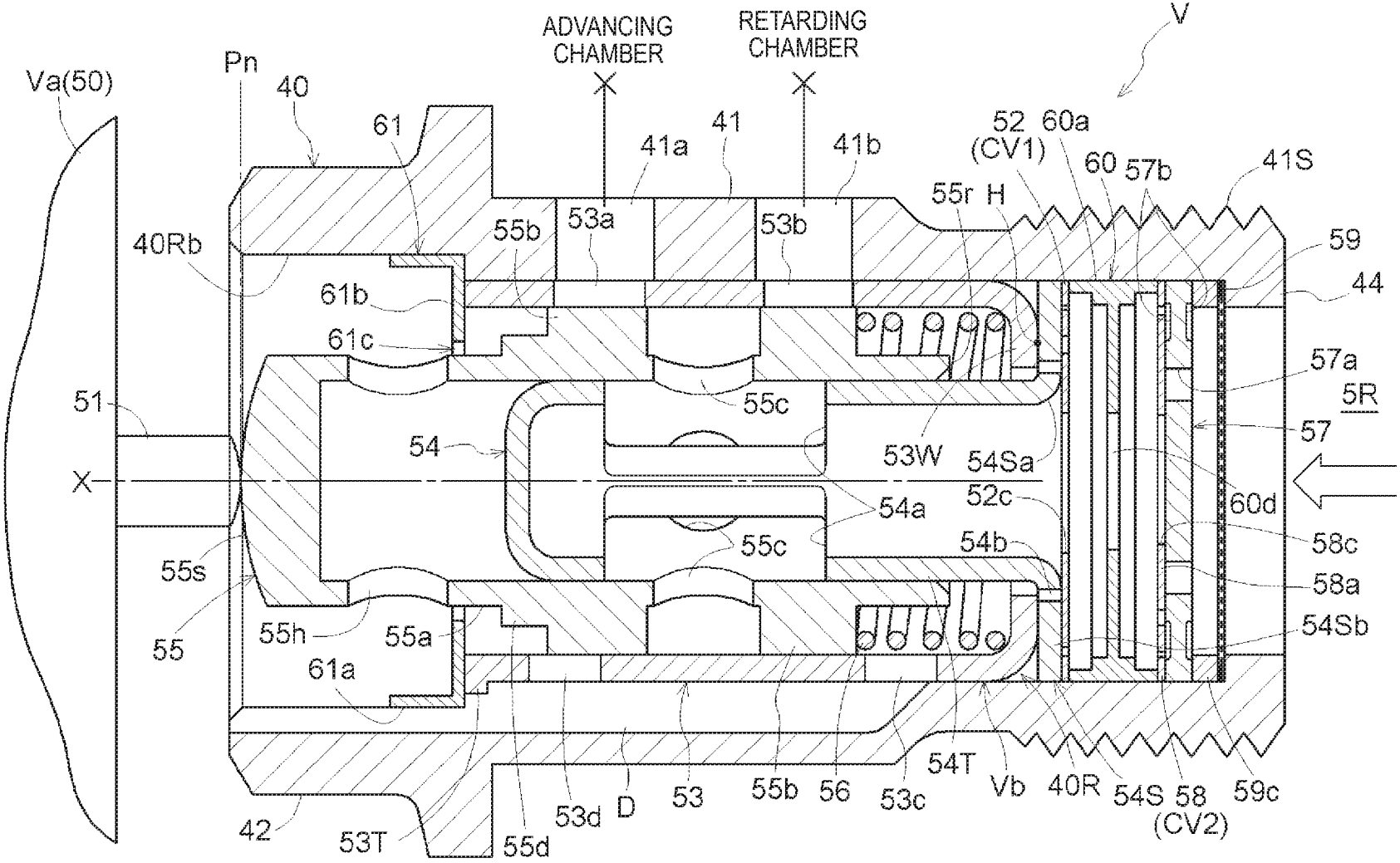
FIG. 4 is a sectional view of the valve unit in which the spool is in a neutral position.
Figure 5:
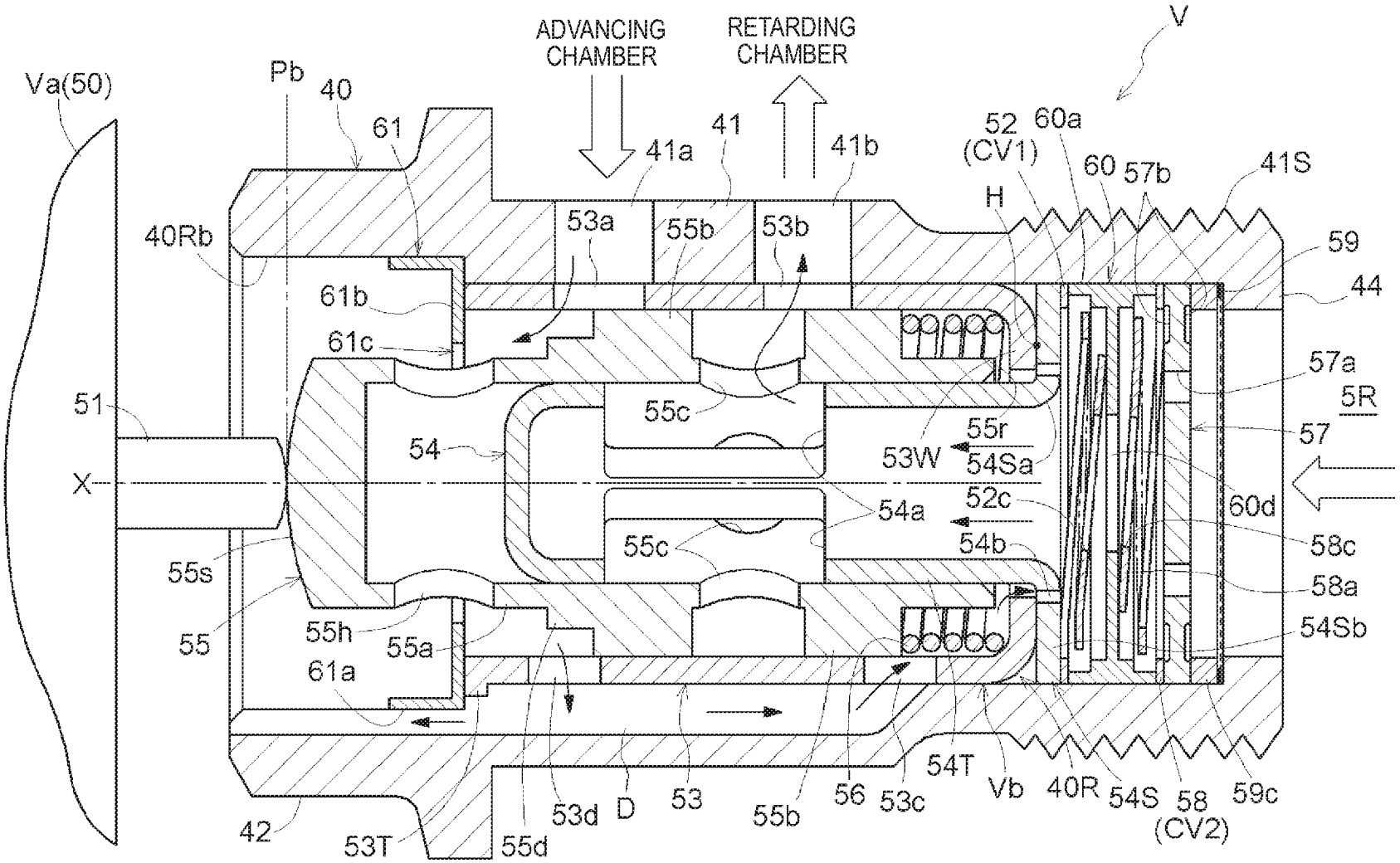
FIG. 5 is a sectional view of the valve unit in which the spool is in a retarding position.
Figure 6:
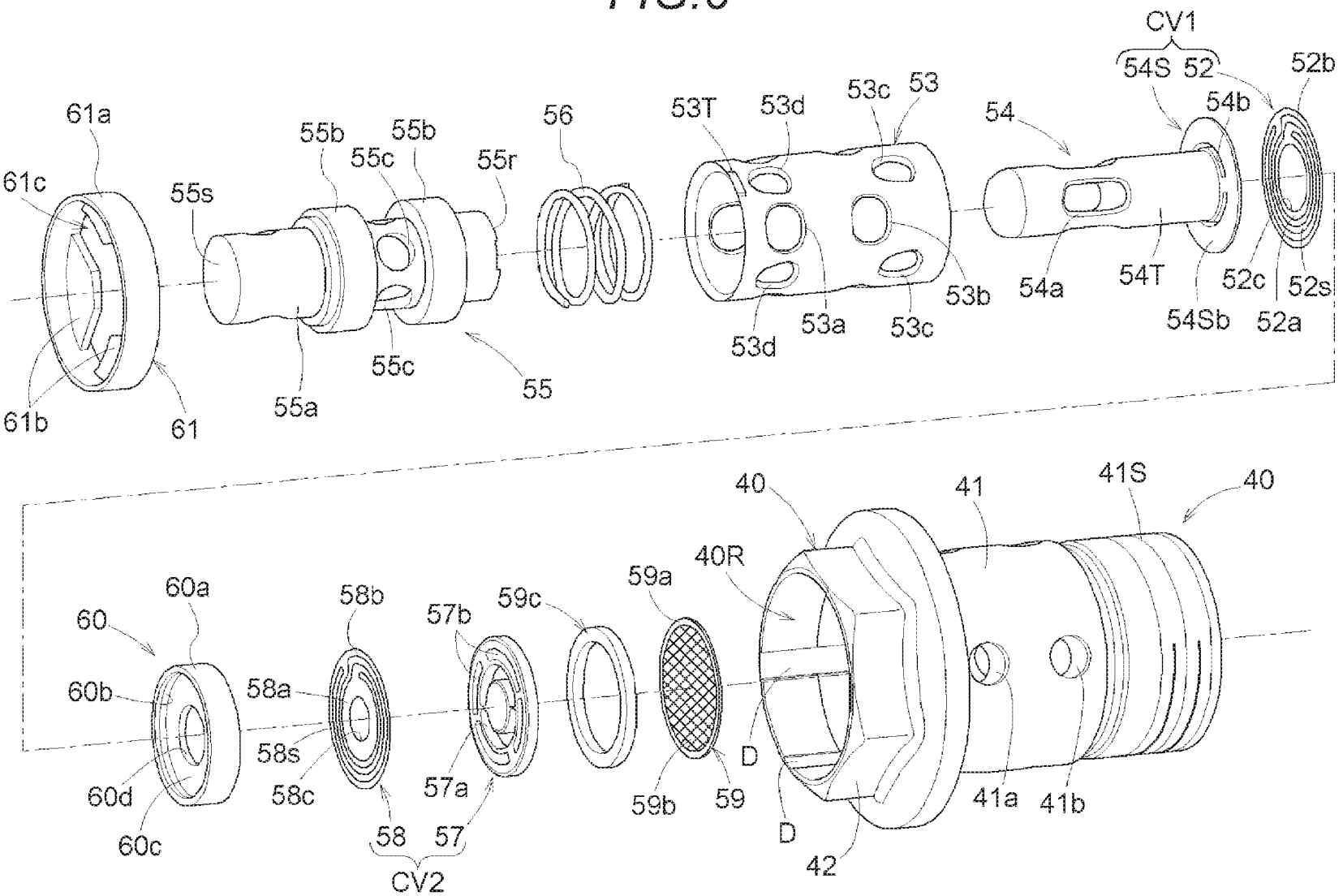
FIG. 6 is an exploded perspective view of the valve unit.

As illustrated in FIGS. 4 to 6, the large-diameter portion 40Rb is formed at the part on the head portion side on the inner peripheral surface of the internal space 40R of the connecting bolt 40.

On the inner peripheral surface of the internal space 40R of the connecting bolt 40, the restriction wall 44 that protrudes in a direction of approaching the rotary shaft center X (protrudes toward the inside of the internal space 40R) is formed in the end portion on the screw portion side in the direction along the rotary shaft center X. The restriction wall 44 is provided as an annular wall in the shape of the inner peripheral surface.

A plurality (four) of drain grooves D (an example of a space communication path) are formed in a posture along the rotary shaft center X in the region that reaches the tip end (connecting bolt 40) of the large-diameter portion 40Rb from the intermediate position at the inner periphery of the connecting bolt 40.

In the bolt main body 41, an advancing port 41*a* that communicates with the advancing flow passage 33 and a retarding port 41*b* that communicates with the retarding flow passage 34 are formed across the internal space 40R from the outer peripheral surface.

Valve Unit

As illustrated in FIGS. 3 to 6, the valve unit Vb includes a sleeve 53 fitted in a state of tightly adhering to the inner peripheral surface of the main body 41, a fluid supply pipe 54 accommodated in the internal space 40R and coaxial with the rotary shaft center X, and a spool 55 which is disposed slidably along the rotary shaft center X in a state of being guided on the inner peripheral surface of the sleeve 53 and the outer peripheral surface of a pipeline portion 54T of the fluid supply pipe 54, in the internal space 40R of the connecting bolt 40.

Furthermore, the valve unit Vb includes a spool spring 56 that serves as a biasing member for biasing the spool 55 in a protruding direction, a first check valve CV1, a second check valve CV2, a filter 59, a fixing ring 60, and a tip end ring 61.

The first check valve CV1 includes the fluid supply pipe 54, a circulation hole 54*b* included therein, and a first valve plate 52 having an annular valve plate 52*a*.

The second check valve CV2 includes an opening plate 57 that serves as a valve seat member and a second valve plate 58 having a valve body 58*a*.

The fixing ring 60 has an outer tube portion 60*a* fitted in the internal space 40R, an inner tube portion 60*b* having an inner diameter smaller than that of the cylindrical outer tube portion 60*a*, and a wall portion 60*c* that perpendicularly intersects with the rotary shaft center X in the direction along the rotary shaft center X in the intermediate position in the fixing ring 60. In the wall portion 60*c*, a circular opening portion 60*d* centering around the rotary shaft center X is formed.

The tip end ring 61 has an outer tube portion 61*a* fitted in the internal space 40R and a wall portion 61*b* that perpendicularly intersects with the rotary shaft center X on the screw portion side of the outer tube portion 61*a*. In the wall portion 61*b*, an opening portion 61*c* centering around the rotary shaft center X is formed.

Valve Unit: Sleeve

As illustrated in FIGS. 3 to 6, the sleeve 53 is a tubular member centering around the rotary shaft center X. In the sleeve 53, a plurality (two) of engagement projections 53T that protrude from the outer periphery of the tube of the sleeve 53 in the direction intersecting with the direction along the rotary shaft center X are formed on the head portion side. In addition, the sleeve 53 is formed by drawing an end portion wall 53W by bending the screw portion side in a posture orthogonal to the rotary shaft center X.

As the engagement projection 53T is fitted to the drain groove D, the posture of the sleeve 53 around the rotary shaft center X is determined, and a state where a drain hole 53*c* and a drain hole 53*d* which will be described later communicate with the drain groove D is maintained.

In the sleeve 53, a plurality of advancing communication bores 53*a* for allowing the advancing port 41*a* to communicate with the internal space 40R, a plurality of retarding communication bores 53*b* for allowing the internal space 40R to communicate with the retarding port 41*b*, and a plurality of drain holes 53*c* for discharging the hydraulic oil in the internal space 40R to the outer surface side of the sleeve 53 are formed in a shape of an angular hole (rectangular shape). The drain hole 53*c* is formed on the screw portion side in the sleeve 53.

Further, the sleeve 53 has a drain hole 53*d* on the head portion side.

The advancing communication bore 53*a* and the retarding communication bore 53*b* are formed in parallel in the direction along the rotary shaft center X at four locations in a peripheral direction centering around the rotary shaft center X.

The drain hole 53*c* is formed at four locations having different phases in the advancing communication bore 53*a* and in the retarding communication bore 53*b* in the peripheral direction centering around the rotary shaft center X.

The drain hole 53*d* is formed at four locations having different phases in the advancing communication bore 53*a* and in the retarding communication bore 53*b* in the peripheral direction centering around the rotary shaft center X.

In the peripheral direction, each of the drain hole 53*c* and drain hole 53*d* is provided in a pair with the same phase. In other words, the pair of drain hole 53*c* and the drain hole 53*d* is disposed in parallel in the direction along the rotary shaft center X.

The above-described engagement projection 53T is disposed on an extended line in the direction along the rotary shaft center X with reference to two of the four drain holes 53*c* opposing each other with the rotary shaft center X interposed therebetween.

With the configuration, in a state where the engagement projection 53T is along the drain groove D, by fitting the sleeve 53 into the internal space 40R of the connecting bolt 40, the drain groove D of the connecting bolt 40 that serves as the valve case is disposed between the connecting bolt 40 and the sleeve 53, and it is possible to form a space communication path surrounded by the inner peripheral surface of the groove of the drain groove D and the outer peripheral surface of the sleeve 53 between the connecting bolt 40 and the sleeve 53. Since the drain groove D is formed reaching the region that reaches the tip end of the connecting bolt 40, the space communication path is formed to communicate with the outside of the connecting bolt 40.

In addition, the advancing communication bore 53*a* and the advancing port 41*a* communicate with each other. In addition, the retarding communication bore 53*b* and the retarding port 41*b* communicate with each other. Further, a state where the drain hole 53*c* and the drain hole 53*d* communicate with the drain groove D is maintained.

Accordingly, in the valve unit Vb, the space (the space further on the intake cam shaft 5 side than on the pair of land portions 55*b* side) between the sleeve 53 and the spool 55, and the space (the space further on the side opposing the electromagnetic unit Va than the pair of land portions 55*b*) between the spool 55 (outer periphery of the spool main body 55*a*) and the intake cam shaft 5 side of the wall portion 61*b* communicate with the drain groove D that serves as the space communication path formed between the connecting bolt 40 and the sleeve 53.

Valve Unit: Fluid Supply Pipe

As illustrated in FIGS. 3 to 6, in the fluid supply pipe 54, a base end portion 54S fitted into the internal space 40R and a pipeline portion 54T that has a diameter smaller than that of the base end portion 54S and extends from the base end portion 54S toward the head portion side in the internal space 40R are integrally formed, and a supply port 54*a* is formed at the outer periphery of the distal end portion of the pipeline portion 54T.

The base end portion 54S has a circular shape having a diameter fitted in the internal space 40R centering around the rotary shaft center X and includes an intermediate wall 54Sb (an example of a base end portion partition wall) in a posture orthogonal to the rotary shaft center X and a second check valve CV2. The base end portion 54S has a supply pipe opening portion 54Sa for supplying the hydraulic oil from the screw portion side toward the inside of the fluid supply pipe 54.

The three supply ports 54*a* formed at the outer periphery of the distal end portion of the pipeline portion 54T have a long hole shape that extends in the direction along the rotary shaft center X. In addition, the four intermediate hole portions 55*c* formed in the spool 55 have a circular shape. Further, the number of supply ports 54*a* and the number of intermediate hole portions 55*c* formed in the spool 55 are different from each other and the opening width of the supply port 54*a* in the peripheral direction is formed to be larger than the width of the intermediate part (a certain part between the supply ports 54*a* and 54*a* adjacent to each other in the peripheral direction among the parts of the pipeline portion 54T) of the supply ports 54*a* adjacent to each other in the peripheral direction. Accordingly, it is possible to reliably supply the hydraulic oil from the pipeline portion 54T to the intermediate hole portion 55*c*.

In the intermediate wall 54Sb, the circulation hole 54*b* that forms a part of the second check valve CV2 is formed. In the circulation hole 54*b*, a pair of through ports are disposed in an arc shape symmetrical around the rotary shaft center X, in an annular region along the outer periphery of the pipeline portion 54T centering around the rotary shaft center X. In the embodiment, the circulation hole 54*b* is two slit-like through ports formed in an arc shape. Details of the second check valve CV2 will be described later.

Valve Unit: Spool and Spool Spring

As illustrated in FIGS. 3 to 6, the spool 55 is formed in a tubular shape. The spool 55 has a spool main body 55*a* in which an operation end portion 55*s* is formed at a tip end. At the outer periphery of the spool main body 55*a*, the pair of land portions 55*b* formed in a protruding state is formed. In addition, at the outer periphery of the spool main body 55*a*, a plurality (four) of intermediate hole portions 55*c* for allowing the intermediate position of the pair of land portions 55*b* and the inside of the spool 55 to communicate with each other are formed. Between the operation end portion 55*s* and the side opposing the electromagnetic unit Va of the pair of land portions 55*b*, a drain through hole 55*h* that penetrates the spool main body 55*a* in the direction intersecting with (in the embodiment, orthogonal to) the rotary shaft center X is provided.

On the side opposite to the operation end portion 55*s* in the spool 55, when the spool 55 is operated in a pushing-in direction, an abutting end portion 55*r* that abuts against the end portion wall 53W and determines an operation limit is formed to be integrated with the land portion 55*b*. The abutting end portion 55*r* is configured to have a diameter smaller that of the land portion 55*b* in the end portion of the region where the spool main body 55*a* extends.

The spool spring 56 is a compression coil type, and is disposed between the land portion 55*b* on the inner side and the end portion wall 53W of the sleeve 53. Due to the action of the biasing force, in the spool 55, the land portion 55*b* on the head portion side abuts against the wall portion 61*b* and is maintained at an advancing position Pa illustrated in FIG. 3. The land portion 55*b* on the head portion side has a small-diameter portion 55*d* that extends to the wall portion 61*b* side, and the small-diameter portion 55*d* abuts against the wall portion 61*b*.

Furthermore, in the valve unit Vb, the position relation is set such that the end portion wall 53W of the sleeve 53 and the intermediate wall 54Sb of the fluid supply pipe 54 abut against each other in the direction along the rotary shaft center X. The end portion wall 53W and the intermediate wall 54Sb are configured as a seal portion H for blocking the flow of the hydraulic oil by increasing the flat surface accuracy between the end portion wall 53W and the intermediate wall 54Sb that abut against each other in this manner.

In addition, the end portion wall 53W is provided apart from the outer peripheral surface of the pipeline portion 54T, and a gap is formed. From the gap, the hydraulic oil discharged into the space between the sleeve 53 and the spool 55 from the advancing chamber Ca or the retarding chamber Cb can flow to the circulation hole 54*b*.

In the configuration, the position of the base end portion 54S of the fluid supply pipe 54 is fixed by the fixing ring 60. Therefore, the base end portion 54S functions as a retainer.

In addition, since the biasing force of the spool spring 56 acts on the end portion wall 53W of the sleeve 53, the end portion wall 53W pressure-welds the intermediate wall 54Sb of the base end portion 54S.

Therefore, by setting the postures of the end portion wall 53W and the intermediate wall 54Sb such that the end portion wall 53W and the intermediate wall 54Sb can tightly adhere to each other, the end portion wall 53W tightly adheres to the intermediate wall 54Sb by using the biasing force of the spool spring 56, and the part is configured as the seal portion H.

First Check Valve

Figure 7:
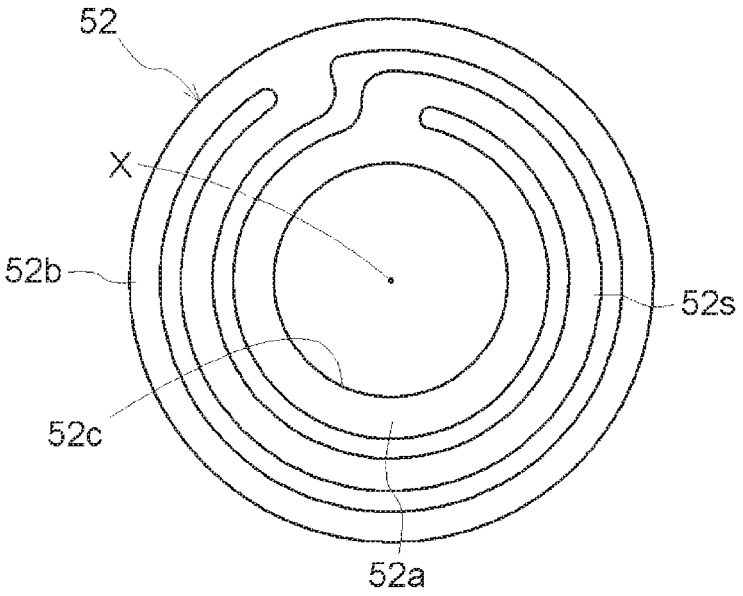
FIG. 7 is a front view of a first valve plate.

As illustrated in FIGS. 6 and 7, the base end portion 54S that configures the first check valve CV1 and the first valve plate 52 are formed of a metal material having the same outer diameter, and the first valve plate 52 is disposed in a position of being in contact with the intermediate wall 54Sb on the screw portion side of the intermediate wall 54Sb. In particular, a spring plate material is used for the first valve plate 52.

The first valve plate 52 includes an annular valve plate 52*a* centering around the rotary shaft center X in the center position, an annular portion 52*b* centering around the rotary shaft center X disposed at the outer periphery, and a spiral spring portion 52*s* so as to connect the annular valve plate 52*a* and the annular portion 52*b* to each other. In the annular valve plate 52*a*, an opening portion 52*c* in which an outer diameter side is larger than that of an annular region where the above-described circulation hole 54*b* is formed and an inner diameter side is smaller than that of the annular region, is formed. In the configuration, the opening portion 52*c* is formed in a circular shape centering around the rotary shaft center X. Accordingly, the annular valve plate 52*a* can close the circulation hole 54*b* when the annular valve plate 52*a* tightly adheres to the circulation hole 54*b*.

In the first valve plate 52, as illustrated in FIGS. 3 to 6, the annular portion 52*b* is sandwiched between the outer tube portion 60*a* of the fixing ring 60 and the intermediate wall 54Sb and is fixed by the internal space 40R.

With such a configuration, when assembling the first check valve CV1, only by fitting the first valve plate 52 into the internal space 40R of the connecting bolt 40 between the fluid supply pipe 54 and the fixing ring 60, an optimum position relation of each portion is achieved, and the operation, such as positioning, becomes unnecessary.

In the first check valve CV1, in a case where the pressure on the screw portion side on the downstream side of the first check valve CV1 is lower than that of the space between the sleeve 53 and the spool 55, as illustrated in FIGS. 3 and 5, the spring portion 52*s* (refer to FIG. 6) is elastically deformed, and accordingly, the annular valve plate 52*a* is separated from the circulation hole 54*b* and the flow of the hydraulic oil is allowed. The annular valve plate 52*a* swings the inner side of the inner tube portion 60*b* of the fixing ring 60 back and forth within a range to the wall portion 60*c* of the fixing ring 60 along the rotary shaft center X, and allows the flow of the hydraulic oil.

In the first check valve CV1, in a case where the pressure on the screw portion side rises, or in a case where the spool 55 is set in a neutral position Pn, as illustrated in FIG. 4, the annular valve plate 52*a* tightly adheres to the circulation hole 54*b* to close the circulation hole 54*b* by the elastic force of the spring portion 52*s*, and closes the circulation hole 54*b*. As a result, the backward flow from the screw portion side to the head portion side is prevented.

Further, since the pair of circulation holes 54*b* symmetrical around the rotational shaft center X is formed in the intermediate wall 54Sb, a pressure without deviation is applied to the annular valve plate 52*a* and the annular valve plate 52*a* is reliably opened, and it becomes possible to send (circulate) the hydraulic oil that has passed through the pair of intermediate walls 54Sb and flowed out to a screw portion side space of the intermediate wall 54Sb, to the fluid supply pipe 54 via the opening portion 52*c* of the annular valve plate 52*a*.

With such a configuration, while using the spring plate material, it is possible to reduce the size of the first check valve CV1, and to accommodate the first check valve CV1 in the internal space 40R of the connecting bolt 40. Further, for example, compared to a configuration in which the check valve is provided on the outside of the connecting bolt 40, it is possible to simplify the flow passage configuration. In addition, since the first check valve CV1 is disposed in the vicinity of the flow passage that communicates with the advancing chamber Ca or the retarding chamber Cb, it also becomes possible to perform the closing operation with excellent response.

Second Check Valve

Figure 8:
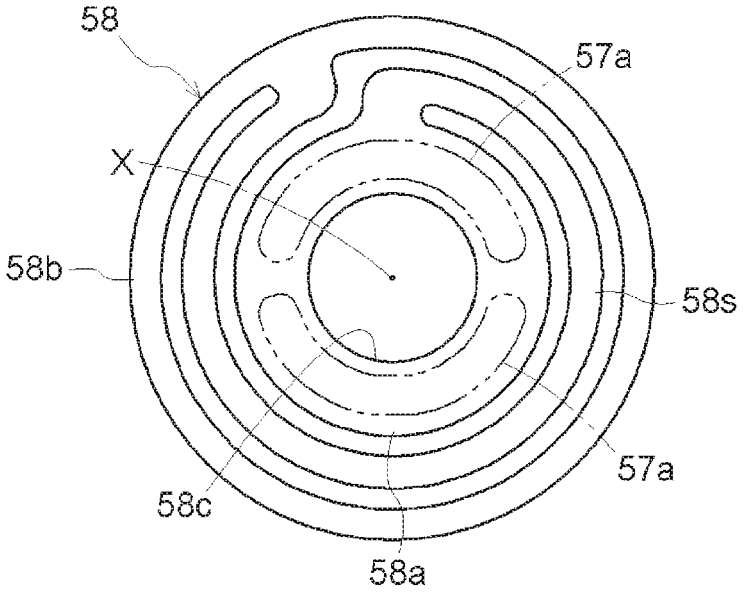
FIG. 8 is a front view of a second valve plate.

As illustrated in FIGS. 6 and 8, the opening plate 57 and the second valve plate 58 that configure the second check valve CV2 are formed of a metal material having the same outer diameter, the opening plate 57 is disposed on the upstream side in the supply direction of the hydraulic oil, and the second valve plate 58 is disposed at a position that is in contact with the opening plate 57 further on the downstream side. In particular, a spring plate material is used for the second valve plate 58.

The opening plate 57 is formed in an arc shape in which a pair of flow ports 57*a* are symmetrical around the rotary shaft center X, in an annular region centering around the rotary shaft center X. In addition, on a face opposing the second valve plate 58 in the opening plate 57, a plurality of groove portions 57*b* which form an arc shape centering around the rotary shaft center X are formed in a region that surrounds the flow port 57*a*.

The second valve plate 58 includes the circular valve body 58*a* centering around the rotary shaft center X in the center position, an annular portion 58*b* centering around the rotary shaft center X disposed at the outer periphery, and a spiral spring portion 58*s* so as to connect the valve body 58*a* and the annular portion 58*b* to each other. In the valve body 58*a*, an opening portion 58*c* in which an outer diameter side is larger than that of an annular region where the above-described flow port 57*a* is formed and an inner diameter side is smaller than that of the annular region, is formed. In the configuration, the opening portion 58*c* is formed in a circular shape centering around the rotary shaft center X. Accordingly, the valve body 58*a* can close the flow port 57*a* when the valve body 58*a* tightly adheres to the flow port 57*a*.

In the second valve plate 58, the annular portion 58*b* is sandwiched between the outer tube portion 60*a* of the fixing ring 60 and the opening plate 57 and is fixed by the internal space 40R.

With such a configuration, when assembling the second check valve CV2, only by fitting the second valve plate 58 and the opening plate 57 into the internal space 40R of the connecting bolt 40, an optimum position relation of each portion is achieved, and the operation, such as positioning, becomes unnecessary.

In addition, in the second check valve CV2, in a case where the hydraulic oil is supplied, as illustrated in FIGS. 3 and 5, the spring portion 58*s* is elastically deformed, and accordingly, the valve body 58*a* is separated from the flow port 57*a* and allows the flow of the hydraulic oil. The valve body 58*a* swings the inner side of the inner tube portion 60*b* of the fixing ring 60 back and forth within a range to the wall portion 60*c* of the fixing ring 60 along the rotary shaft center X, and allows the flow of the hydraulic oil.

In the second check valve CV2, in a case where the pressure on the head portion side which is the downstream side of the second check valve CV2 rises, in a case where the discharge pressure of the hydraulic pump P decreases, or in a case where the spool 55 is set in the neutral position Pn, as illustrated in FIG. 4, due to the elastic force of the spring portion 58*s*, the valve body 58*a* tightly adheres to the flow port 57*a* to close the flow port 57*a* of the opening plate 57 and closes the flow port 57*a*. As a result, the backward flow from the downstream side to the upstream side is prevented. In particular, in a case of closing the flow port 57*a* with the valve body 58*a*, since the groove portion 57*b* is formed in the opening plate 57, the inconvenience that the spring portion 58*s* tightly adheres to the opening plate 57 and becomes difficult to be separated therefrom is suppressed.

Filter

Furthermore, the filter 59 includes a filtering portion 59*b* which is a mesh member in which the central portion of an annular frame body 59*a* having an outer diameter equal to that of the opening plate 57 and the second valve plate 58 allows the flow of the hydraulic oil.

The filter 59 is fitted into the internal space 40R of the connecting bolt 40 in a state where an annular supporting member 59*c* is interposed between the opening plate 57 and the filter 59.

Since the second check valve CV2 is configured in this manner, it becomes possible to reduce the size. Moreover, as illustrated in FIGS. 3 and 5, in a case where the second check valve CV2 is in an open state, the hydraulic oil that flows through the pair of flow ports 57*a* formed on the opening plate 57 can pass through the opening portion 58*c* of the valve body 58*a* and the opening portion 60*d*. Accordingly, in a position in the vicinity of the rotary shaft center X that has passed through the opening portion 58*c*, as the hydraulic oil flows along the rotary shaft center X, for example, inconvenience that the hydraulic oil comes into contact with the inner wall of the pipeline portion 54T of the fluid supply pipe 54 and causes a pressure loss is eliminated, and the supply of the hydraulic oil in a state where the pressure loss is suppressed is realized.

In addition, since the pair of flow ports 57*a* having a shape symmetrical around the rotary shaft center X is formed on the opening plate 57, a pressure without deviation is applied to the valve body 58*a*, the valve body 58*a* is reliably opened, and it also becomes possible to send the hydraulic oil that has passed through the pair of flow ports 57*a* to the opening portion 58*c* of the valve body 58*a*.

In particular, since the second check valve CV2 is accommodated in the internal space 40R of the connecting bolt 40, for example, since the flow passage configuration is simplified compared to the configuration in which the second check valve CV2 is provided on the outside of the connecting bolt 40, and the second check valve CV2 is disposed in the vicinity of the flow passage that communicates with the advancing chamber Ca or the retarding chamber Cb, it also becomes possible to perform the closing operation with excellent responsiveness.

Fixing of Valve Unit, First Check Valve, Second Check Valve, and Filter

First, as illustrated in FIG. 6, the filter 59 is inserted from the head portion side of the internal space 40R and abuts against the restriction wall 44. After this, the supporting member 59*c*, the opening plate 57, the second valve plate 58, the fixing ring 60, the first valve plate 52, and the fluid supply pipe 54 are inserted into the internal space 40R in this order and abut against each other.

Furthermore, the engagement projection 53T of the sleeve 53 is fitted into the drain groove D, the sleeve 53 is inserted into the internal space 40R, and the end portion wall 53W of the sleeve 53 abuts against the intermediate wall 54Sb of the fluid supply pipe 54.

Furthermore, the spool spring 56 and the spool 55 are fitted from the outside of the pipeline portion 54T of the fluid supply pipe 54 in this order and are inserted into the internal space 40R.

Finally, the tip end ring 61 is press-fitted into the internal space 40R toward the screw portion side. At the time of the press-fitting, the spool main body 55*a* of the spool 55 is inserted into the opening portion 61*c* of the tip end ring 61, the land portion 55*b* in the head portion side position is pressed against the wall portion 61*b* of the tip end ring 61, and the tip end part on the head portion side of the spool main body 55*a* is in a state of protruding to the head portion side from the tip end ring 61. In addition, the tip end ring 61 is press-fitted into the internal space 40R against the biasing force of the spool spring 56 that biases the land portion 55*b* in the screw portion side position toward the head portion side.

When the press-fitting of the tip end ring 61 is completed, the spool 55, the spool spring 56, the sleeve 53, the fluid supply pipe 54, the first check valve CV1, the fixing ring 60, the second check valve CV2, and the filter 59 are positioned in the internal space 40R from the head portion side toward the screw portion side between the tip end ring 61 and the restriction wall 44.

Control Aspect of Hydraulic Oil

In the valve timing controller A, in a state where no electric power is supplied to the solenoid portion 50 of the electromagnetic unit Va, no pressing force acts on the spool 55 from the plunger 51, as illustrated in FIG. 3, the spool 55 is maintained in a position where the land portion 55*b* in the outer position abuts against the wall portion 61*b* by the biasing force of the spool spring 56.

The position of the spool 55 is the advancing position Pa, and based on the position relation between the pair of land portions 55*b* and the advancing communication bore 53*a* and the retarding communication bore 53*b*, the intermediate hole portion 55*c* of the spool 55 and the advancing communication bore 53*a* communicate with each other, and the retarding communication bore 53*b* communicates with the space (internal space 40R) on the inner side of the sleeve 53.

Accordingly, the hydraulic oil to be supplied from the hydraulic pump P is supplied from the supply port 54*a* of the fluid supply pipe 54 to the advancing chamber Ca via the intermediate hole portion 55*c* of the spool 55, the advancing communication bore 53*a*, and the advancing port 41*a*.

At the same time, the hydraulic oil in the retarding chamber Cb is discharged from the retarding port 41*b* to the space between the sleeve 53 and the spool 55 via the retarding communication bore 53*b*.

A part of the hydraulic oil discharged into the space between the sleeve 53 and the spool 55 circulates to the fluid supply pipe 54 via the first check valve CV1. The hydraulic oil that has circulated is supplied to the advancing chamber Ca together with the hydraulic oil to be supplied from the hydraulic pump P. By the circulation of the hydraulic oil, the hydraulic oil is quickly supplied to the advancing chamber Ca.

The remainder of the hydraulic oil discharged into the space between the sleeve 53 and the spool 55 flows to the drain hole 53*c* and is discharged to the outside from the end portion on the head portion side of the connecting bolt 40 via the drain groove D.

As a result of the feeding and discharging and the circulation of the hydraulic oil, the relative rotation phase quickly displaces in the advancing direction Sa.

In particular, in a case where the locking mechanism L is in the locked state, the spool 55 is set at the advancing position Pa, the hydraulic oil is supplied, and accordingly, a part of the hydraulic oil to be supplied to the advancing chamber Ca is supplied from the advancing flow passage 33 to the locking mechanism L, the lock member 25 is disengaged from the lock recess portion 23*a* and the unlocking is also realized.

By supplying the predetermined electric power to the solenoid portion 50 of the electromagnetic unit Va, the plunger 51 protrudes, and it is possible to set the spool 55 to the neutral position Pn illustrated in FIG. 4 against the biasing force of the spool spring 56.

In a case where the spool 55 is set to the neutral position Pn, the pair of land portions 55*b* is in a position relation of closing the advancing communication bore 53*a* and the retarding communication bore 53*b* of the sleeve 53, the hydraulic oil is not supplied to and discharged from the advancing chamber Ca and the retarding chamber Cb, and the relative rotation phase is maintained.

By supplying the electric power that exceeds the above-described predetermined electric power to the solenoid portion 50 of the electromagnetic unit Va, the plunger 51 further protrudes, and it is possible to set the spool 55 to the retarding position Pb illustrated in FIG. 5.

In the retarding position Pb, based on the position relation of the pair of land portions 55*b* and the advancing communication bore 53*a* and the retarding communication bore 53*b*, the intermediate hole portion 55*c* of the spool 55 and the retarding communication bore 53*b* communicate with each other. Further, the advancing communication bore 53*a* communicates with the space between the sleeve 53 and the spool 55 via the drain hole 53*d*, the drain groove D, and the drain hole 53*c*, from the space between the outer periphery of the spool main body 55*a* and the intake cam shaft 5 side of the wall portion 61*b* of the tip end ring 61. At the same time, the advancing communication bore 53*a* communicates with the external space from the space between the outer periphery of the spool main body 55*a* and the intake cam shaft 5 side of the wall portion 61*b* via the drain hole 53*d* and the drain groove D.

Accordingly, the hydraulic oil to be supplied from the hydraulic pump P is supplied from the supply port 54*a* of the fluid supply pipe 54 to the retarding chamber Cb via the intermediate hole portion 55*c* of the spool 55, the retarding communication bore 53*b*, and the retarding port 41*b*.

At the same time, the hydraulic oil in the advancing chamber Ca is discharged from the advancing port 41*a* via the advancing communication bore 53*a* to the space between the outer periphery of the spool main body 55*a* and the intake cam shaft 5 side of the wall portion 61*b*.

A part of the hydraulic oil discharged to the space between the outer periphery of the spool main body 55*a* and the intake cam shaft 5 side of the wall portion 61*b*, flows into the space between the sleeve 53 and the spool 55 via the drain hole 53*d*, the drain groove D, and the drain hole 53*c*, from the space. A part of the hydraulic oil that has flowed into the space between the sleeve 53 and the spool 55 circulates to the fluid supply pipe 54 via the first check valve CV1. The hydraulic oil that has circulated is supplied to the retarding chamber Cb together with the hydraulic oil to be supplied from the hydraulic pump P. By the circulation of the hydraulic oil, the hydraulic oil is quickly supplied to the retarding chamber Cb.

The remainder of the hydraulic oil discharged to the space between the outer periphery of the spool main body 55*a* and the intake cam shaft 5 side of the wall portion 61*b* is discharged to the outside via the drain hole 53*d* and the drain groove D.

As a result of the feeding and discharging and the circulation of the hydraulic oil, the relative rotation phase quickly displaces in the retarding direction Sb.

Second Embodiment

Hereinafter, a second embodiment of the valve timing controller according to the disclosure will be described.

The second embodiment is different from the first embodiment in that the valve unit Vb does not use the sleeve 53. In addition, the second embodiment is different from the first embodiment in that the spool 55 has a drain path DL (another example of the space communication path) instead of the drain groove D of the sleeve 53 in the first embodiment.

Furthermore, in the second embodiment, the shape of the inner peripheral surface of the internal space 40R is different from that of the first embodiment. In addition, the second embodiment is different from the first embodiment in that the valve unit Vb includes a rear end ring 62 instead of the tip end ring 61, and accordingly, the method and aspect of fixing the vale unit Vb and the like is different from those of the first embodiment.

Other configurations of the second embodiment are similar to those of the first embodiment. In the following, the differences will be described, and the description of the common configuration will be omitted.

Figure 9:
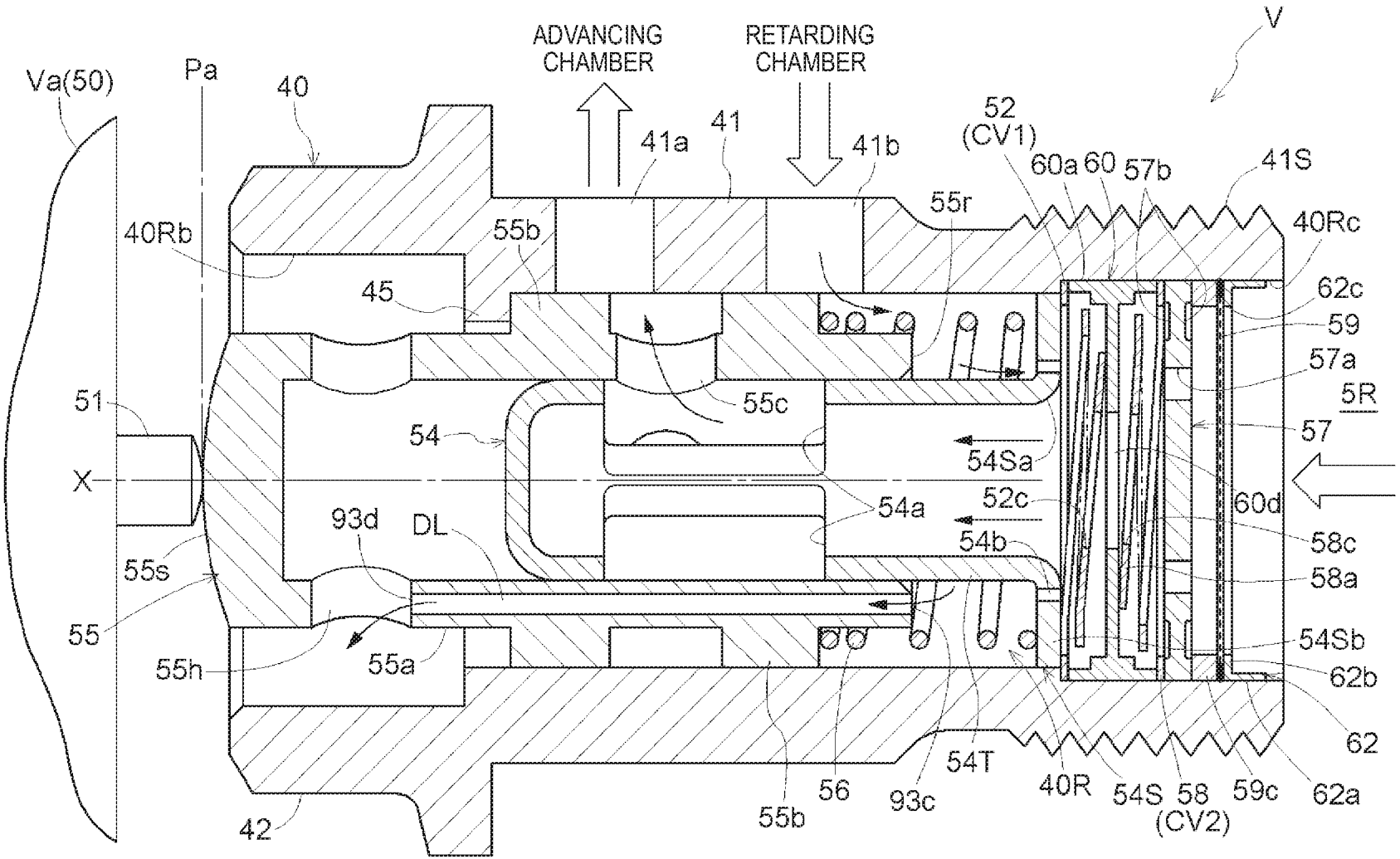
FIG. 9 is a sectional view of a valve unit of a second embodiment in which a spool is in an advancing position.
Figure 10:
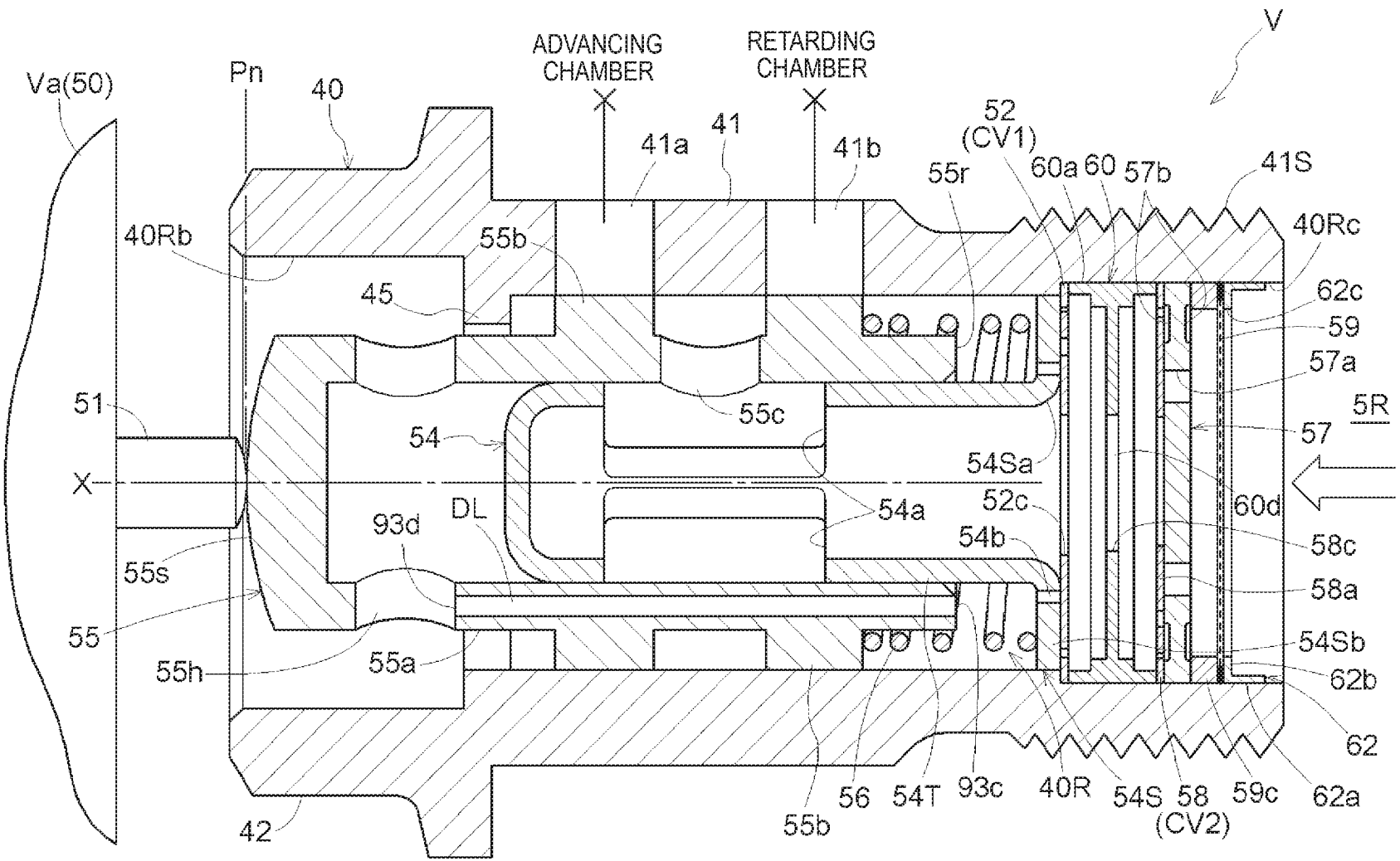
FIG. 10 is a sectional view of the valve unit of the second embodiment in which the spool is in a neutral position.
Figure 11:
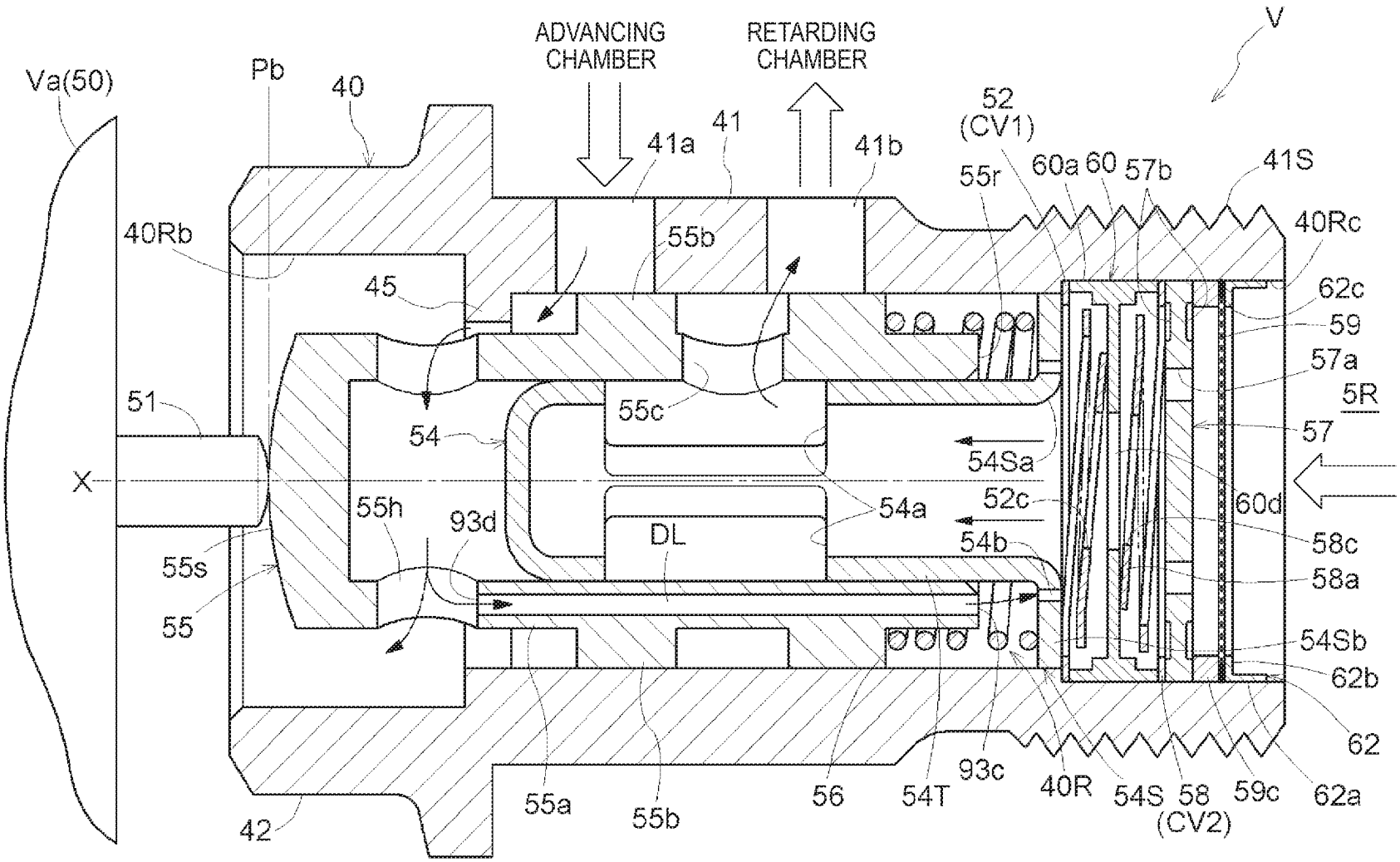
FIG. 11 is a sectional view of the valve unit of the second embodiment in which the spool is in a retarding position.
Figure 12:
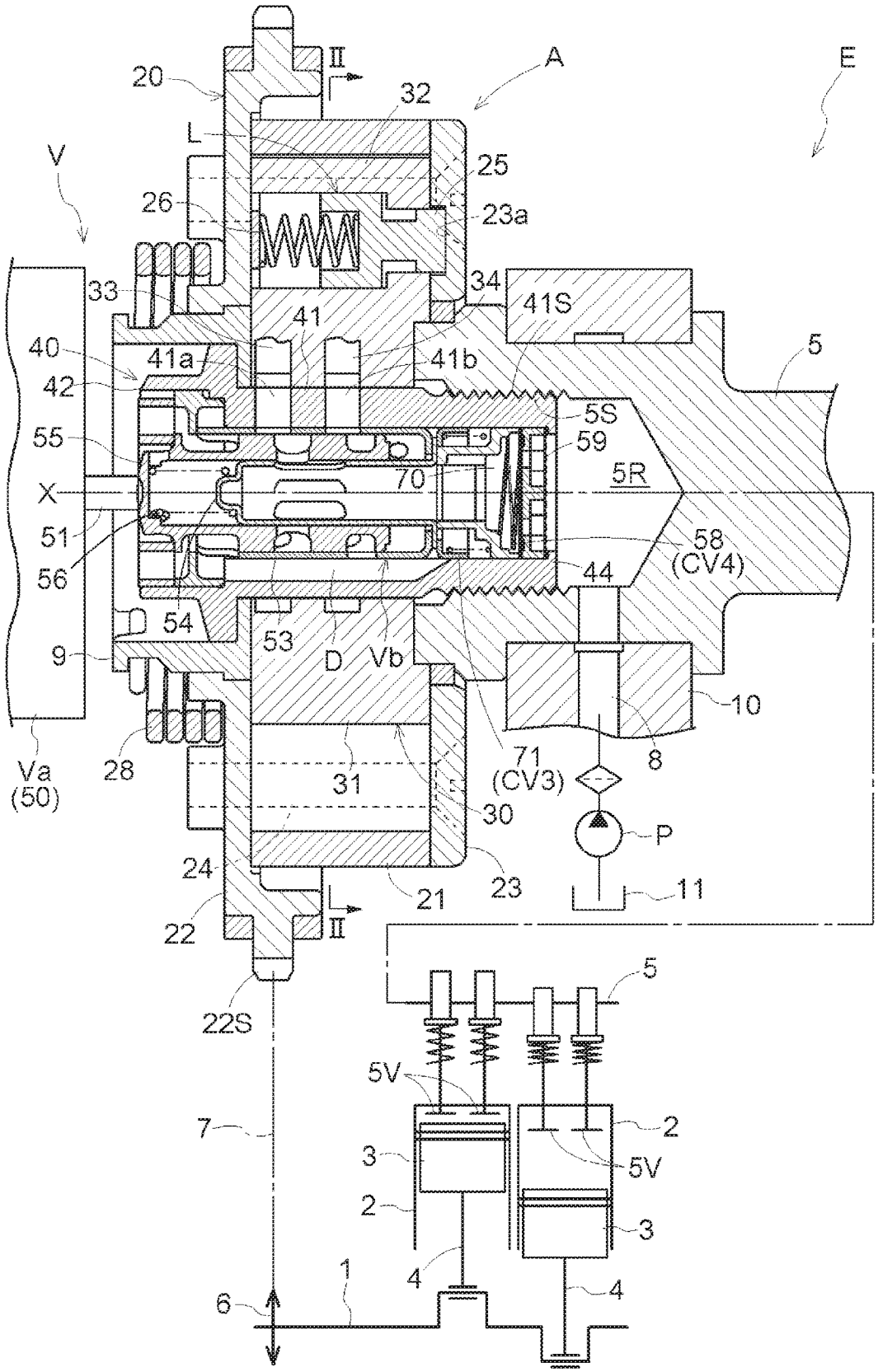
FIG. 12 is a sectional view illustrating the overall configuration of a valve timing controller of a third embodiment.

As illustrated in FIGS. 9 to 11, a large-diameter portion 40Rc is formed at the part on the screw portion side on the inner peripheral surface of the internal space 40R of the connecting bolt 40.

In the screw portion side end portion of the large-diameter portion 40Rb of the connecting bolt 40, a restriction wall 45 that protrudes in the direction of approaching the rotary shaft center X is formed. The restriction wall 45 is provided on the same plane (in the same position in the direction along the rotary shaft center X) as one or a plurality of arc-shaped walls, in a shape of the inner peripheral surface.

The rear end ring 62 has an outer tube portion 62*a* fitted in the internal space 40R and a wall portion 62*b* that perpendicularly intersects with the rotary shaft center X on the screw portion side of the outer tube portion 62*a*. In the wall portion 62*b*, an opening portion 62*c* centering around the rotary shaft center X is formed.

As illustrated in FIGS. 9 to 11, the drain path DL is provided in the spool main body 55*a* of the spool 55. The drain path DL is provided to extend from the intake cam shaft 5 side rather than the pair of land portions 55*b* until reaching the side opposing the electromagnetic unit Va rather than the pair of land portions 55*b*, at the rotary shaft center X of the spool main body 55*a*.

The drain passage DL includes a drain hole 93*c* that communicates with a space further on the intake cam shaft 5 side of the pair of land portions 55*b* and a drain hole 93*d* that communicates with the space between the spool 55 and the intake cam shaft 5 side of the wall portion 61*b*, in the internal space 40R.

In the embodiment, the drain path DL is provided in a range from the drain hole 93*c* provided in the end portion on the intake cam shaft 5 side of the spool main body 55*a* of the spool 55 until reaching the drain hole 93*d* provided on the inner wall of the hole of the drain through hole 55*h* provided between the operation end portion 55*s* and the side opposing the electromagnetic unit Va of the pair of land portions 55*b*. The drain hole 93*d* communicates with the space between the spool 55 and the intake cam shaft 5 side of the wall portion 61*b* via the drain through hole 55*h*.

In other words, the drain path DL communicates with the space further on the intake cam shaft 5 side than on the pair of land portions 55*b* side in the internal space 40R via the drain hole 93*c*. In addition, the drain path DL communicates with the space between the spool 55 and the intake cam shaft 5 side of the wall portion 61*b* in the internal space 40R via the drain hole 93*d*. The drain path DL is a tubular flow passage having a drain hole 93*c* and a drain hole 93*d* as opening ends.

Accordingly, the space further on the intake cam shaft 5 side than on the pair of land portions 55*b* side and the space between the spool 55 and the intake cam shaft 5 side of the wall portion 61*b* communicate with each other via the drain path DL. In addition, the space further on the intake cam shaft 5 side than on the pair of land portions 55*b* side and the space between the spool 55 and the intake cam shaft 5 side of the wall portion 61*b* communicate with the outside via the drain path DL.

Fixing of Valve Unit, First Check Valve, Second Check Valve, and Filter

Unlike the case illustrated in FIG. 6, the spool 55, the spool spring 56, and the fluid supply pipe 54 are inserted into the internal space 40R from the screw portion side in this order. At the time of the insertion, the pair of land portions 55*b* of the spool 55 abuts against the restriction wall 45 on the screw portion side. Accordingly, the spool 55 is prevented from being detached from the head portion side of the internal space 40R.

After this, the first valve plate 52, the fixing ring 60, the second valve plate 58, the opening plate 57, the supporting member 59*c*, and the filter 59 are inserted into the large-diameter portion 40Rc of the internal space 40R from the screw portion side in this order.

After this, the rear end ring 62 is press-fitted into the large-diameter portion 40Rc from the screw portion side, and the spool 55, the spool spring 56, the fluid supply pipe 54, the first check valve CV1, the fixing ring 60, the second check valve CV2, and the filter 59 are positioned in the internal space 40R from the head portion side toward the screw portion side between the restriction wall 45 and the rear end ring 62.

Control Aspect of Hydraulic Oil

As illustrated in FIG. 9, in a case where the position of the spool 55 is the advancing position Pa, based on the position relation between the pair of land portions 55*b* and the advancing port 41*a* and the retarding port 41*b*, the intermediate hole portion 55*c* of the spool 55 and the advancing port 41*a* communicate with each other, and the retarding port 41*b* communicates with the space further on the intake cam shaft 5 side than on the pair of land portions 55*b* side in the internal space 40R.

Further, in the advancing position Pa, the drain through hole 55*h* of the spool main body 55*a* in the spool 55 communicates only with the outside.

Accordingly, the hydraulic oil to be supplied from the hydraulic pump P is supplied from the supply port 54*a* of the fluid supply pipe 54 to the advancing chamber Ca via the intermediate hole portion 55*c* of the spool 55 and the advancing port 41*a*.

At the same time, the hydraulic oil in the retarding chamber Cb is discharged from the retarding port 41*b* to the space further on the intake cam shaft 5 side than on the pair of land portions 55*b* side in the internal space 40R.

A part of the hydraulic oil discharged to the space further on the intake cam shaft 5 side than on the pair of land portions 55*b* side in the internal space 40R circulates to the fluid supply pipe 54 via the first check valve CV1. The hydraulic oil that has circulated is supplied to the advancing chamber Ca together with the hydraulic oil to be supplied from the hydraulic pump P. By the circulation of the hydraulic oil, the hydraulic oil is quickly supplied to the advancing chamber Ca.

The remainder of the hydraulic oil discharged to the space further on the intake cam shaft 5 side than on the pair of land portions 55*b* side in the internal space 40R flows to the drain hole 93*c* of the drain path DL. The remainder of the discharged hydraulic oil further flows from the drain hole 94*c* to the drain through hole 55*h* and is discharged to the outside from the end portion on the head portion side of the connecting bolt 40.

As illustrated in FIG. 10, in a case where the spool 55 is set to the neutral position Pn, the pair of land portions 55*b* are in a position relation of closing the advancing port 41*a* and the retarding port 41*b* of the bolt main body 41, the hydraulic oil is not supplied to and discharged from the advancing chamber Ca and the retarding chamber Cb, and the relative rotation phase is maintained.

As illustrated in FIG. 11, in a case where the spool 55 is set at the retarding position Pb, based on the position relation between the pair of land portions 55*b* and the advancing port 41*a* and the retarding port 41*b*, the intermediate hole portion 55*c* of the spool 55 and the retarding port 41*b* communicate with each other. Further, the advancing port 41*a* communicates with the space further on the intake cam shaft 5 side than on the pair of land portion 55*b* side in the internal space 40R via the drain hole 93*d*, the drain passage DL, and the drain hole 93*c*, from the space between the outer periphery of the spool main body 55*a* and the intake cam shaft 5 side of the wall portion 61*b* of the tip end ring 61.

Accordingly, the hydraulic oil to be supplied from the hydraulic pump P is supplied from the supply port 54*a* of the fluid supply pipe 54 to the retarding chamber Cb via the intermediate hole portion 55*c* of the spool 55 and the retarding port 41*b*.

In addition, the drain through hole 55*h* of the spool main body 55*a* of the spool 55 also communicates with the space between the outer periphery of the spool main body 55*a* and the intake cam shaft 5 side of the wall portion 61*b*.

Therefore, in the retarding position Pb, the advancing port 41*a* communicates with the external space from the space between the outer periphery of the spool main body 55*a* and the intake cam shaft 5 side of the wall portion 61*b* via the drain through hole 55*h*, the drain hole 93*d*, and the drain path DL.

At the same time, the hydraulic oil in the advancing chamber Ca is discharged from the advancing port 41*a* to the space between the outer periphery of the spool main body 55*a* and the intake cam shaft 5 side of the wall portion 61*b*.

A part of the hydraulic oil discharged between the outer periphery of the spool main body 55*a* and the intake cam shaft 5 side of the wall portion 61*b* flows into the space further on the intake cam shaft 5 side than on the pair of land portions 55*b* side in the internal space 40R via the drain through hole 55*h*, the drain hole 93*d*, the drain path DL, and the drain hole 93*c*, from the space.

A part of the hydraulic oil that has flowed into the space further on the intake cam shaft 5 side than on the pair of land portions 55*b* side in the internal space 40R circulates to the fluid supply pipe 54 via the first check valve CV1. The hydraulic oil that has circulated is supplied to the retarding chamber Cb together with the hydraulic oil to be supplied from the hydraulic pump P. By the circulation of the hydraulic oil, the hydraulic oil is quickly supplied to the retarding chamber Cb.

The remainder of the hydraulic oil discharged to the space between the outer periphery of the spool main body 55*a* and the intake cam shaft 5 side of the wall portion 61*b* is discharged to the outside from a gap between the spool 55 and the connecting bolt 40.

As described above, the valve timing controller according to the embodiment can realize the circulation of the hydraulic oil between the advancing chamber and the retarding chamber with a simple structure.

Third Embodiment

Hereinafter, a third embodiment of the valve timing controller according to the disclosure will be described. The third embodiment will be described with reference to FIGS. 12 to 20.

Basic Configuration

The configuration of the valve unit Vb of the third embodiment is different from the configuration of the valve unit Vb of the first embodiment mainly in the aspect of the sleeve 53, the fluid supply pipe 54, the spool 55, the spool spring 56, the first check valve CV1, and the second check valve CV2. In addition, instead of the tip end ring 61, a first tip end ring 63 and a second tip end ring 64 are provided. Further, the control aspect of the hydraulic oil differs, in particular, due to the difference in the aspect of the spool 55.

Hereinafter, the configuration that corresponds to the first check valve CV1 of the first embodiment will be described as a third check valve CV3 (an example of the first check valve). Similarly, the configuration that corresponds to the second check valve CV2 will be described as a fourth check valve CV4 (an example of the second check valve).

In the embodiment, the side on which the restriction wall 44 is provided in the connecting bolt 40 (an example of a valve case) is a bottom portion. The large-diameter portion 40Rb which is on the other end side from the bottom portion in the direction along the rotary shaft center X of the connecting bolt 40 is an opening. The screw portion side (upstream side) and the head portion side (downstream side) of the connecting bolt 40 correspond to the side (an example of the opening side) of the large-diameter portion 40Rb to be described later and the side (an example of the bottom portion side) on which a restriction wall 44 is provided.

Other configurations of the valve timing controller A of the third embodiment are similar to those of the first embodiment. In the following, the differences will be described, and the description of the common configuration will be omitted.

Valve Unit

As illustrated in FIGS. 12 to 17, the valve unit Vb includes the sleeve 53 fitted in a state of tightly adhering to the inner peripheral surface of the main body 41 in the internal space 40R of the connecting bolt 40, the fluid supply pipe 54 accommodated in the internal space 40R and coaxial with the rotary shaft center X, and the spool 55 which is disposed slidably along the rotary shaft center X in a state of being guided on the inner peripheral surface of the sleeve 53 and the outer peripheral surface of the pipeline portion 54T of the fluid supply pipe 54.

Furthermore, the valve unit Vb includes the spool spring 56 that serves as a biasing member for biasing the spool 55 in the protruding direction, the third check valve CV3, the fourth check valve CV4, the filter 59, the first tip end ring 63, and the second tip end ring 64. Unlike the first embodiment, the spool spring 56 is accommodated inside the tube of the spool 55. The aspect of the spool spring 56 will be described later.

Figure 19:
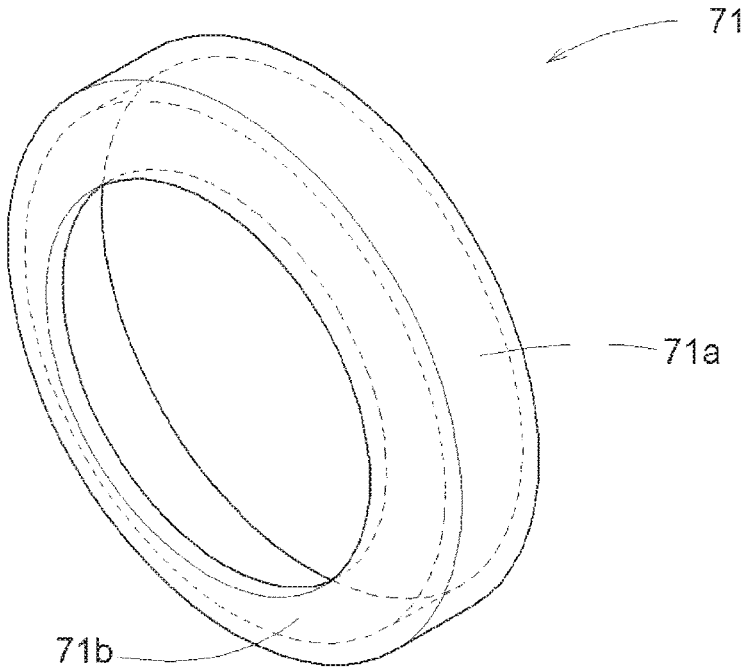
FIG. 19 is a perspective view of a valve seat of a third check valve of the third embodiment.
Figure 20:
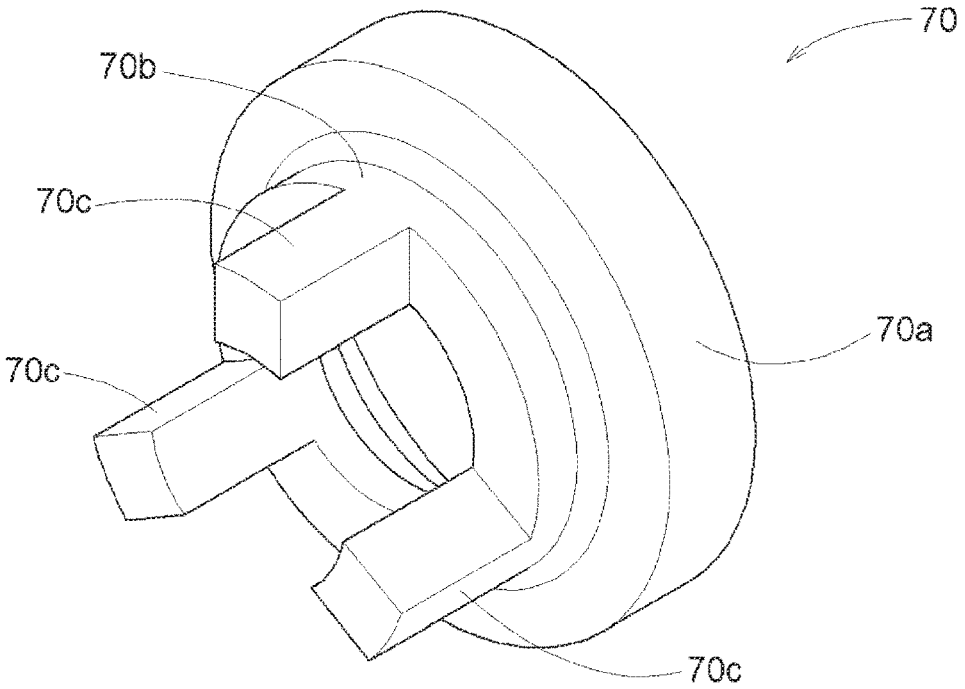
FIG. 20 is a perspective view of a circulation valve of the third check valve of the third embodiment.
Figure 21:
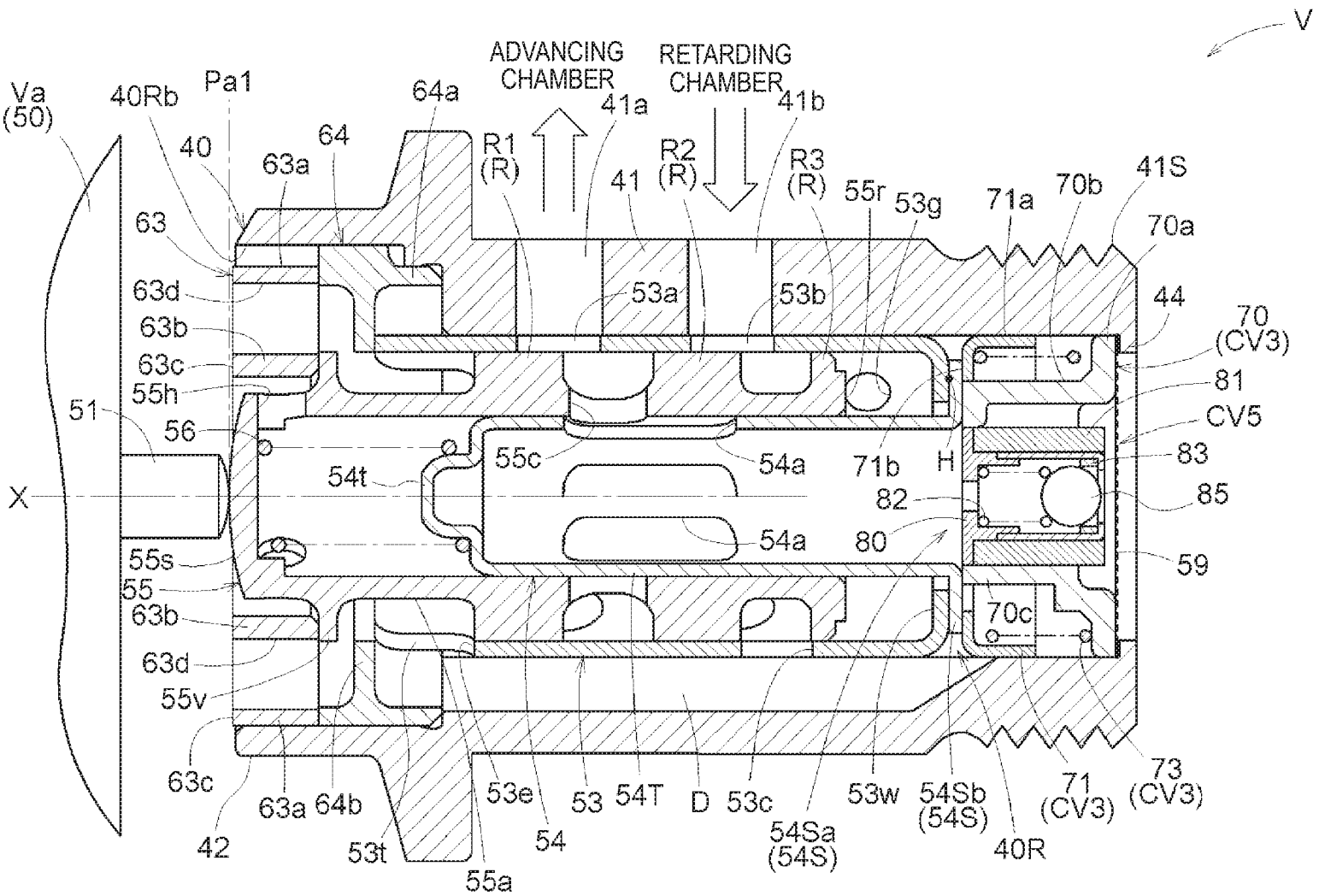
FIG. 21 is an explanatory view of a modification example of the third embodiment.

As illustrated in FIGS. 19 and 20, the third check valve CV3 includes a valve seat 70, a circulation valve 71, and a spring 73.

The fourth check valve CV4 includes a support plate 65 that serves as a valve seat member and the second valve plate 58 having the valve body 58*a*.

The valve seat 70 includes an outer tube portion 70*a* fitted in the internal space 40R, an inner tube portion 70*b* of which the diameter is reduced from the end portion of the head portion side (hereinafter, simply referred to as the head portion side similar to the first embodiment) in the direction along the rotary shaft center X of the outer tube portion 70*a* and the inner diameter is smaller than that of the cylindrical outer tube portion 70*a* that extends to the head portion side, and a support leg portion 70*c* which extends from the head portion side of the inner tube portion 70*b* and extends to the head portion side of the inner tube portion 70*b*. Three support leg portions 70*c* are provided at equal intervals in the peripheral direction (hereinafter, simply referred to as the peripheral direction) at the rotary shaft center X.

The first tip end ring 63 includes an outer ring 63*a* fitted in the large-diameter portion 40Rb in the internal space 40R, an inner ring 63*b* formed on the inside of the outer ring 63*a*, a surface portion 63*c* which is a face that intersects with the rotary shaft center X on the head portion side of the first tip end ring 63 and a face that connects the outer ring 63*a* and the inner ring 63*b* to each other, and a plurality of tip end ring drain hole 63*d* that are a plurality of through holes that pass through the surface portion 63*c*. The six tip end ring drain holes 63*d* are provided at equal intervals in the peripheral direction.

The second tip end ring 64 includes an annular tube portion 64*a* to be fitted into the large-diameter portion 40Rb in the internal space 40R, and an annular lid portion 64*b* which is a face that extends from the inner peripheral surface of the annular tube portion 64*a* radially inward and an annular face having a through hole in the direction along the rotary shaft center X.

Valve Unit: Sleeve

As illustrated in FIGS. 13 to 17, the sleeve 53 is a tubular member centering around the rotary shaft center X. The sleeve 53 is formed by drawing an end portion wall 53*w* by bending the screw portion side in a posture orthogonal to the rotary shaft center X.

In the third embodiment, the drain groove D is formed up to a position capable of communicating with the end portion wall 53*w* and the internal space 40R further on the screw portion side than on the intermediate wall 54Sb side which will be described later. The drain hole 53*c*, a second drain hole 53*g*, and a recess portion 53*e*, which will be described later, communicate with the drain groove D.

In the sleeve 53, a plurality of advancing communication bores 53*a* for allowing the advancing port 41*a* to communicate with the internal space 40R, a plurality of retarding communication bores 53*b* for allowing the internal space 40R to communicate with the retarding port 41*b*, and a plurality of drain holes 53*c* and the second drain holes 53*g* for discharging the hydraulic oil in the internal space 40R to the outer surface side of the sleeve 53 are formed in a shape of an angular hole (rectangular shape). In addition, in the sleeve 53, four tip end projection portions 53*f* that extend from the tube portion of the sleeve 53 to the head portion side along the rotary shaft center X are formed, and the recess portion 53*e* is formed between the respective tip end projection portions 53*f*. The tip end projection portion 53*f* and the recess portion 53*e* are disposed in the peripheral direction at equal intervals in the same shape.

The advancing communication bore 53*a* and the retarding communication bore 53*b* are formed in parallel in the direction along the rotary shaft center X at four locations of which the phases are shifted by 90 degrees in the peripheral direction centering around the rotary shaft center X.

The drain hole 53*c* is formed on the screw portion side in the sleeve 53. The drain hole 53*c* is formed on the screw portion side in the direction along the rotary shaft center X further in the sleeve 53 than the advancing communication bore 53*a* or the retarding communication bore 53*b*. The drain holes 53*c* are formed at two locations having different phases in the advancing communication bore 53*a* and the retarding communication bore 53*b* in the peripheral direction centering around the rotary shaft center X. The drain holes 53*c* at two locations are disposed at phases (positions opposing each other across the rotary shaft center X) shifted from each other by 180 degrees in the peripheral direction (hereinafter, simply described as the peripheral direction) centering around the rotary shaft center X.

The second drain holes 53*g* are formed at two locations having different phases in the advancing communication bore 53*a*, the retarding communication bore 53*b*, and the drain hole 53*c* in the peripheral direction. The second drain hole 53*g* is disposed with a phase different from that of the drain hole 53*c* in the peripheral direction centering around the direction along the rotary shaft center X. The drain hole 53*c* and the second drain hole 53*g* are disposed with a phase shifted by 90 degrees in the peripheral direction from each other. The second drain hole 53*g* is disposed further on the screw portion side in the direction along the rotary shaft center X than the drain hole 53*c*. The second drain holes 53*g* at two locations are disposed with a phase shifted by 180 degrees in the peripheral direction from each other.

From the configuration, by fitting the sleeve 53, the advancing communication bore 53*a* and the advancing port 41*a* communicate with each other. In addition, the retarding communication bore 53*b* and the retarding port 41*b* communicate with each other. Further, a state where the opening part by the drain hole 53*c*, the second drain hole 53*g*, and the recess portion 53*e* communicates with the drain groove D is maintained. The opening part by the recess portion 53*e* will be described later. In addition, the second drain hole 53*g* communicates with the drain groove D different from the drain groove D that communicates with the drain hole 53*c*.

Valve Unit: Fluid Supply Pipe

As illustrated in FIGS. 13 to 17, in the fluid supply pipe 54, the intermediate wall 54Sb inserted into the screw portion side in the internal space 40R, and the pipeline portion 54T which has a diameter smaller than that of the intermediate wall 54Sb and extends from the intermediate wall 54Sb toward the head portion side in the internal space 40R are integrally formed. The supply port 54*a* is formed at the outer periphery of the distal end portion of the pipeline portion 54T. At the tip end of the pipeline portion 54T, a bottomed tubular projection 54*t* having a tube portion in the direction along the rotary shaft center X and having a bottom surface on the head portion side is formed.

Valve Unit: Spool and Spool Spring

As illustrated in FIGS. 13 to 17, the spool 55 includes a spool main body 55*a* having a tubular shape and having the operation end portion 55*s* formed at the tip end, three land portions R formed in a protruding state at the outer periphery, the four intermediate hole portions 55*c* that communicate with the inside of the spool 55, and a tip end valve 55*v* (an example of the valve body) formed between the operation end portion 55*s* and the land portion R.

The three land portions R have a first land R1, a second land R2, and a third land R3 in order from the head portion side to the screw portion side in the direction along the rotary shaft center X. The thickness of the third land R3 in the direction along the rotary shaft center X is relatively thinner than the thickness of the first land R1 or the second land R2.

The tip end valve 55*v* is formed in a rib shape that extends radially outward at the outer periphery of the spool main body 55*a*. The rib of the tip end valve 55*v* is formed in an annular surface shape. The tip end valve 55*v* is an annular plate which intersects with the rotary shaft center X. The shape of the outer periphery of the rib of the tip end valve 55*v* has a shape along the shape of the inner periphery of the annular lid portion 64*b*.

Between the operation end portion 55*s* and the side opposing the electromagnetic unit Va of the first land R1, the drain through hole 55*h* that penetrates the spool main body 55*a* in the direction intersecting with (in the embodiment, orthogonal to) the rotary shaft center X is provided.

The intermediate hole portion 55*c* is provided at the intermediate position between the first land R1 and the second land R2. Hereinafter, the first land R1 and the second land R2 adjacent to the first land R1 are collectively referred to as a pair of land portions on the head portion side. The pair of front land portions corresponds to the pair of land portions 55*b* of the first embodiment. In addition, the second land R2 and the third land R3 are collectively referred to as a pair of land portions on the screw portion side.

In the head portion side end portion of the spool 55 opposite to the operation end portion 55*s*, when the spool 55 is operated in the pushing-in direction, an abutting end portion 55*r* that abut against the end portion wall 53W and determines the operation limit is formed to be integrated with the third land R3. The abutting end portion 55*r* is configured to have a diameter smaller that of the land portion R in the end portion of the region where the spool main body 55*a* extends.

The spool spring 56 is a compression coil type spring. The spool spring 56 is disposed on the head portion side of the projection 54*t* of the pipeline portion 54T on the inside of the spool 55. The projection 54*t* is inserted into the coil on the screw portion side of the spool spring 56. The spool spring 56 biases the operation end portion 55*s* of the spool 55 from the inside of the spool 55 toward the head portion side with respect to the pipeline portion 54T with the projection 54*t* as a fulcrum. Under the action of the biasing force, in a state where no electric power is supplied to the solenoid portion 50 of the electromagnetic unit Va, the face on the head portion side of the tip end valve 55*v* of the spool 55 abuts against the screw portion side end portion of the inner ring 63*b*, and is maintained in a first advancing position Pa1 illustrated in FIG. 13.

Furthermore, in the valve unit Vb, the position relation is set such that the end portion wall 53*w* of the sleeve 53 and the intermediate wall 54Sb of the base end portion 54S of the fluid supply pipe 54 abut against each other in the direction along the rotary shaft center X. The end portion wall 53*w* and the intermediate wall 54Sb are configured as a seal portion H for blocking the flow of the hydraulic oil by increasing the flat surface accuracy between the end portion wall 53*w* and the intermediate wall 54Sb that abut against each other in this manner. In addition, the screw portion side of the intermediate wall 54Sb abuts against the support leg portion 70*c* of the valve seat 70. In addition, the biasing force of the spool spring 56 acts on the fluid supply pipe 54 from the projection 54*t*. Accordingly, the fluid supply pipe 54 is biased to the screw portion side.

Third Check Valve

Figure 14:
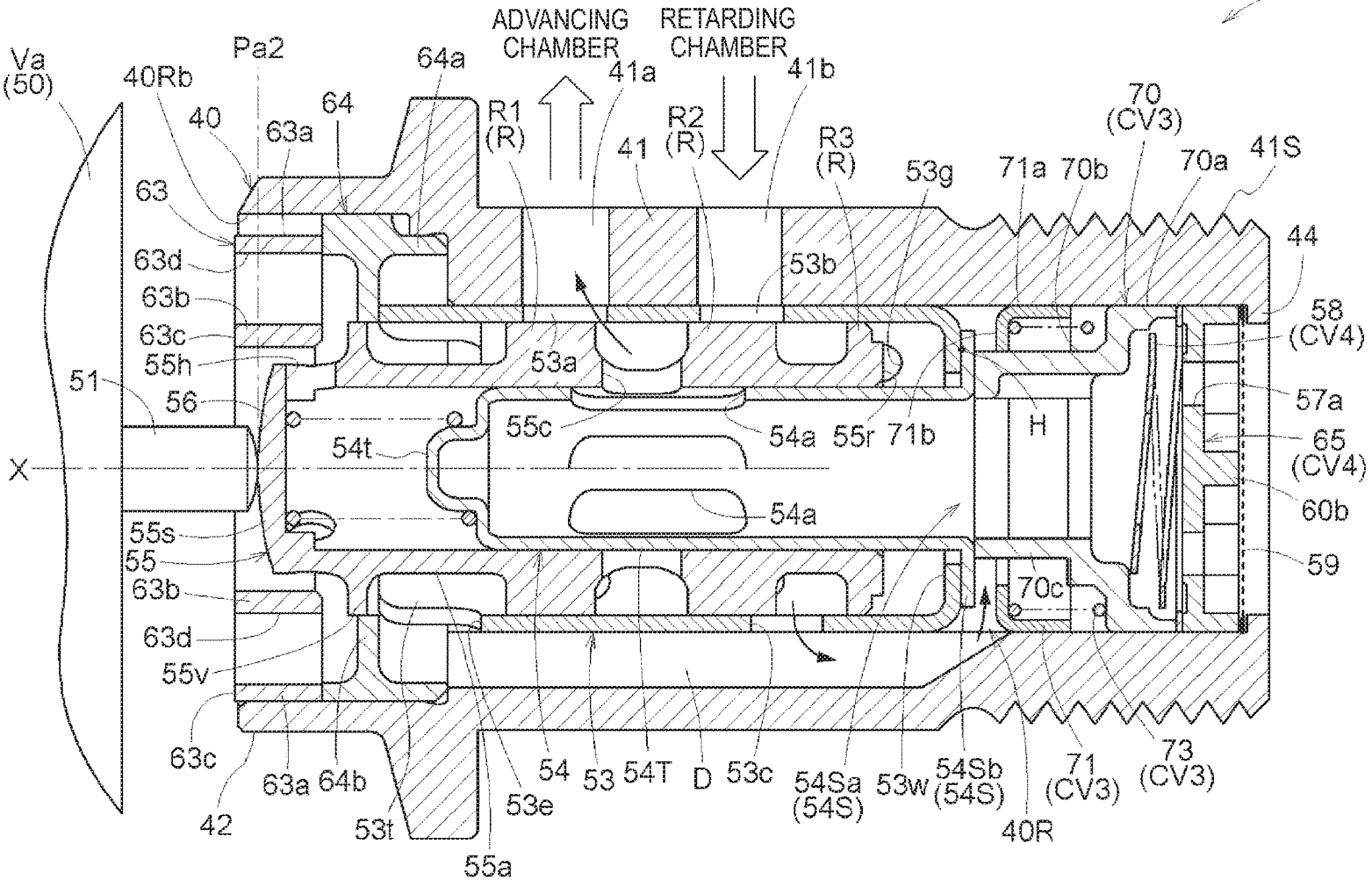
FIG. 14 is a sectional view of a valve unit in which the spool is in a second advancing position.
Figure 17:
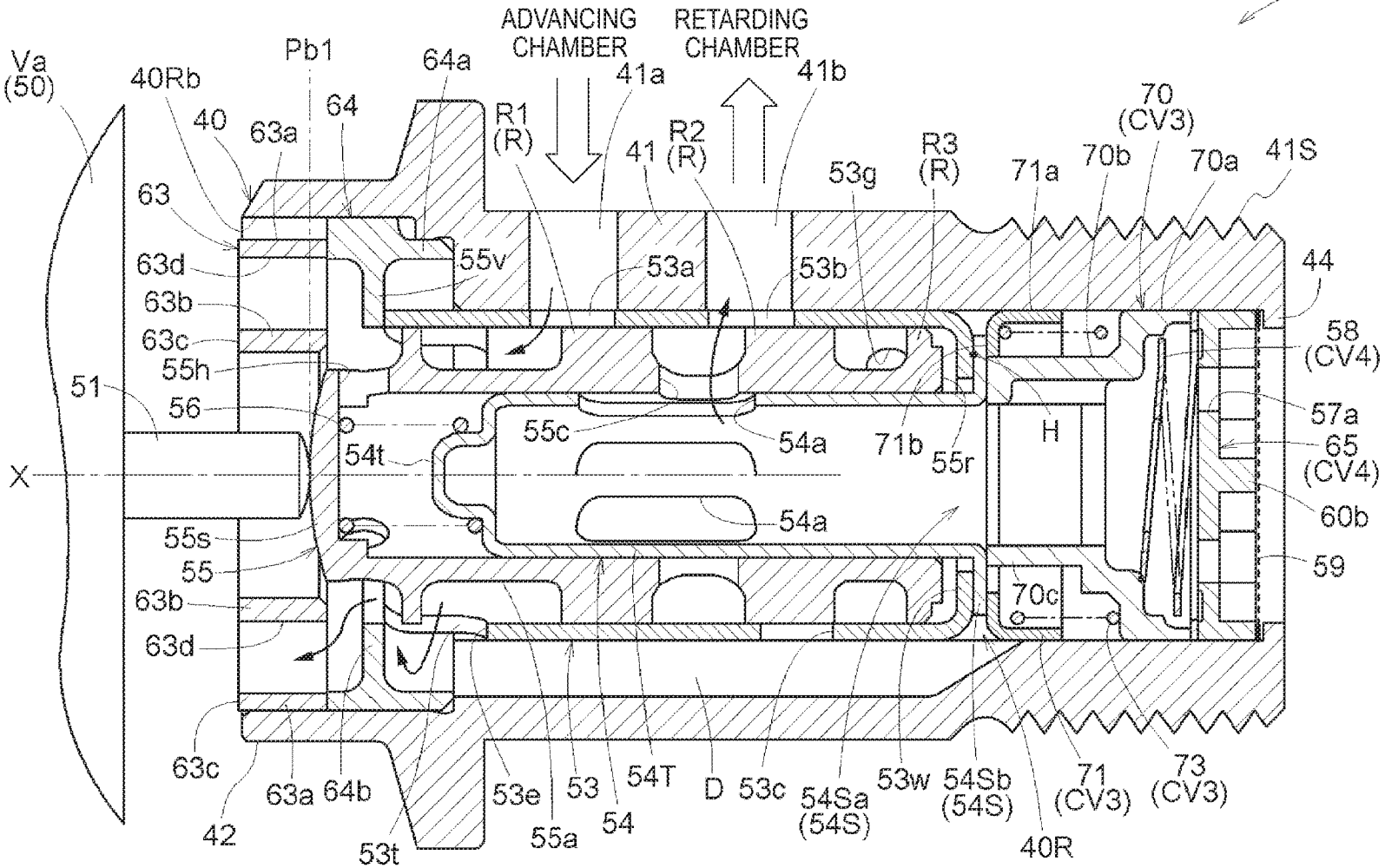
FIG. 17 is a sectional view of the valve unit in which the spool is in a first retarding position.

As illustrated in FIGS. 14 and 17, the third check valve CV3 includes the valve seat 70, the circulation valve 71, and the spring 73. The third check valve CV3 is configured to bias the circulation valve 71 to the head portion side by the spring 73 fitted to the outside of the inner tube portion 70*b* of the valve seat 70.

The circulation valve 71 has a tube portion 71*a* that can be fitted in and slidable in the internal space 40R and a front surface portion 71*b* that extends in a face-like manner radially inward from the head portion side of the tube portion 71*a*. The front surface portion 71*b* abuts against the screw portion side of the intermediate wall 54Sb in a state where the circulation valve 71 is most biased toward the head portion side. In a state where the front surface portion 71*b* is in tight contact with the screw portion side of the intermediate wall 54Sb, the circulation valve 71 is in a state of closing the screw portion side end portion of the drain groove D by the tube portion 71*a* and the front surface portion 71*b*, and closing the drain groove D with respect to the internal space 40R further on the screw portion side than on the end portion wall 53*w* side and the intermediate wall 54Sb which will be described later. In this state, the hydraulic oil does not flow from the internal space 40R further on the screw portion side than on the end portion side wall 53*w* and the intermediate wall 54Sb which will be described later to the drain groove D.

Figure 16:
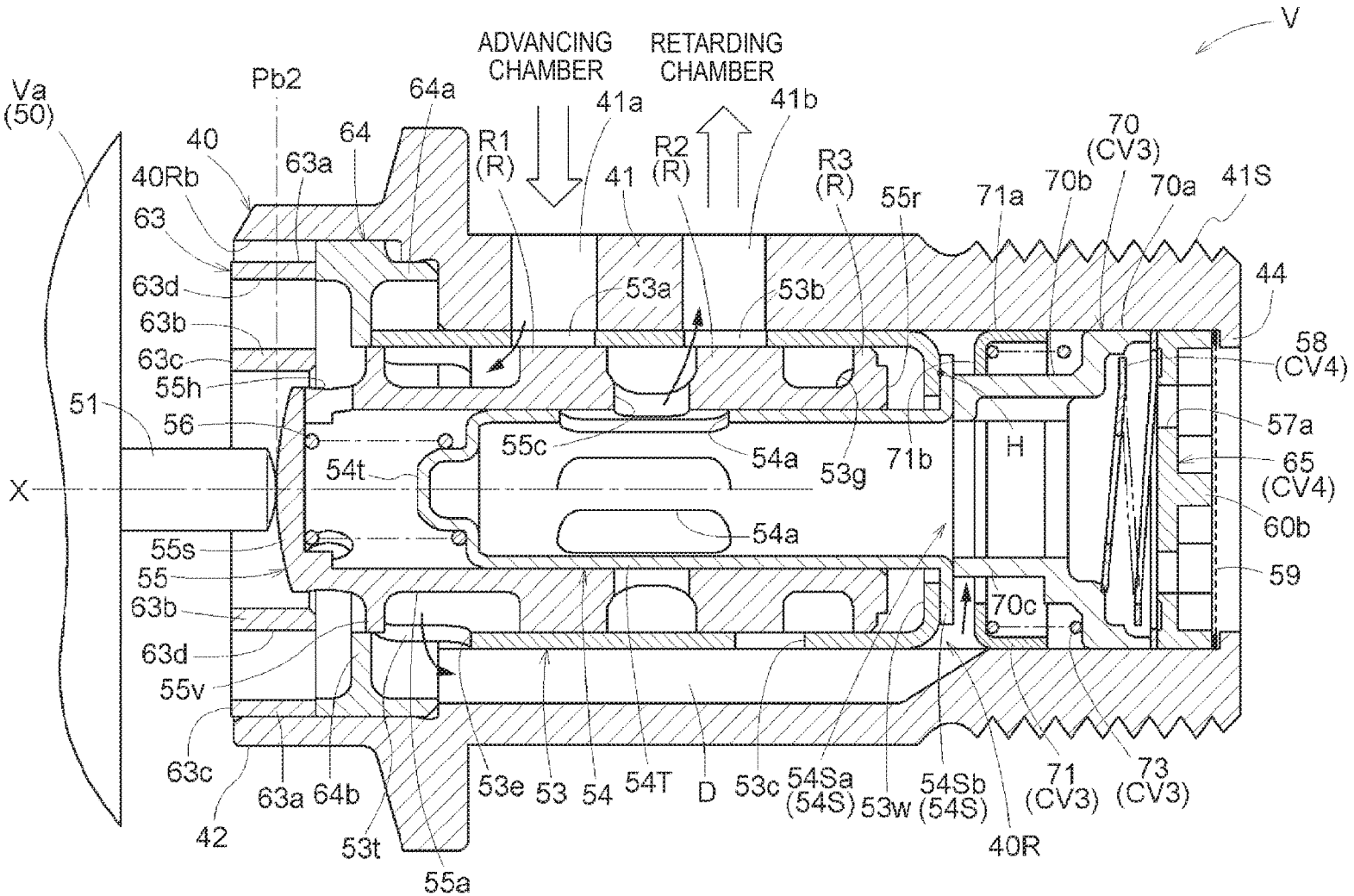
FIG. 16 is a sectional view of the valve unit in which the spool is in a second retarding position.

In the third check valve CV3, in a case where the pressure of the hydraulic oil in the internal space 40R further on the screw portion side than on the end portion wall 53*w* side and the intermediate wall 54Sb side which are the downstream side of the third check valve CV3 is reduced to be lower than the pressure of the hydraulic oil in the drain groove D, as illustrated in FIGS. 14 and 16, the hydraulic oil in the drain groove D biases the circulation valve 71 to the screw portion side against the biasing force of the spring 73. Accordingly, the circulation valve 71 retreats to the screw portion side, and allows the hydraulic oil to flow from the drain groove D to the internal space 40R further on the screw portion side than on the end portion wall 53*w* side and the intermediate wall 54Sb side which will be described later.

Figure 13:
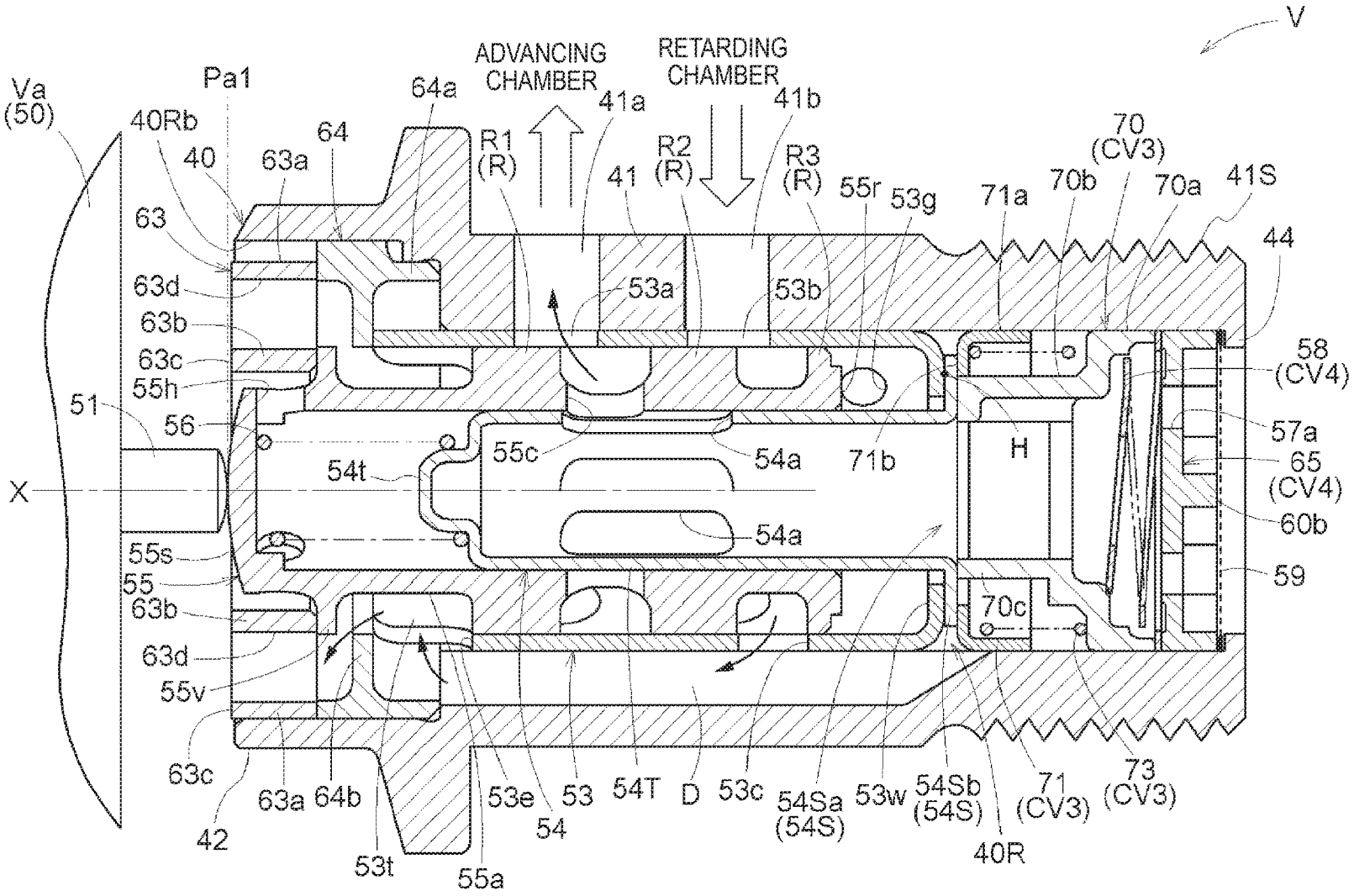
FIG. 13 is a sectional view of a valve unit in which a spool is in a first advancing position.
Figure 15:
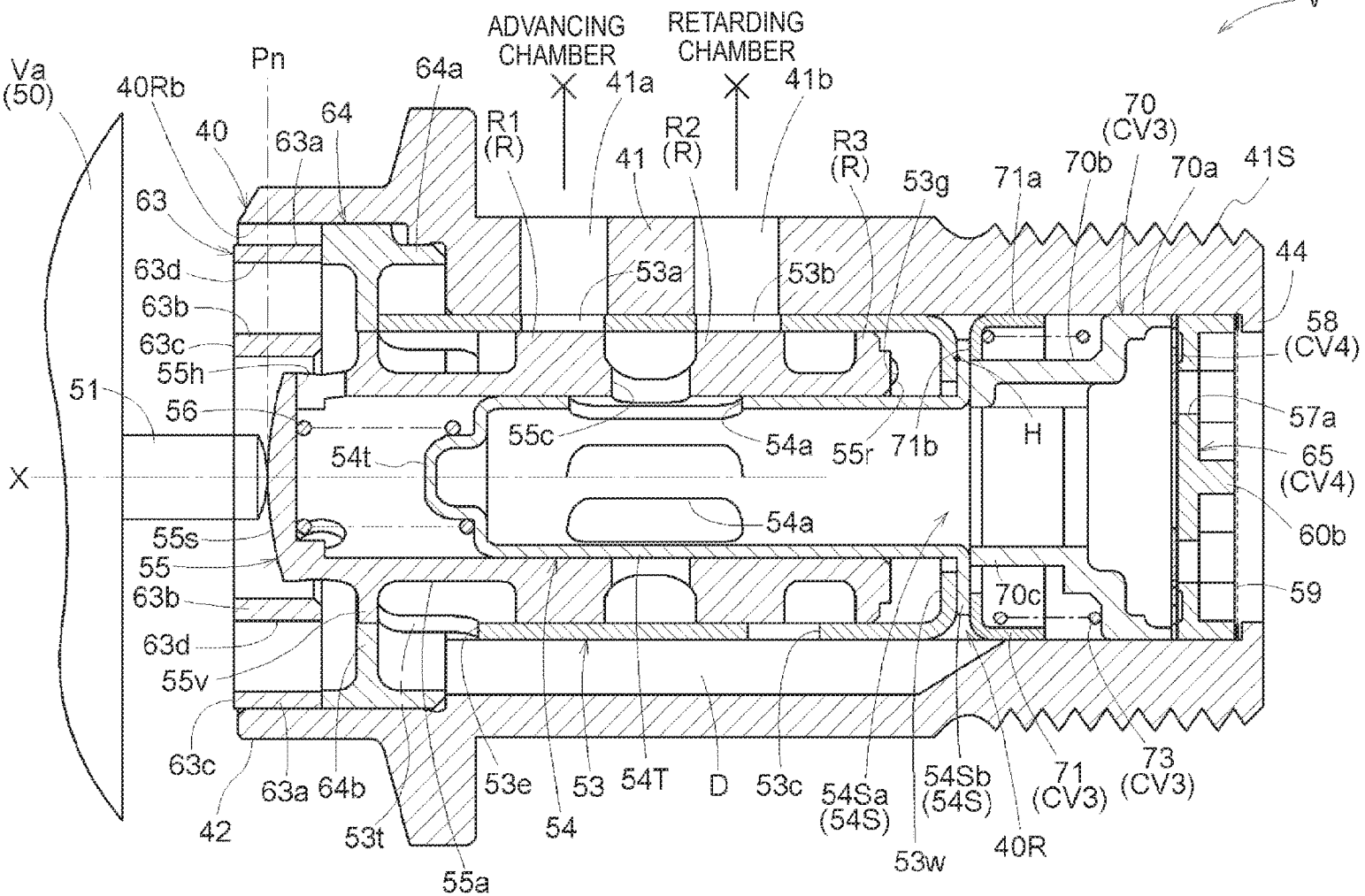
FIG. 15 is a sectional view of the valve unit in which the spool is in a neutral position.

In addition, as will be described later, in a case where the pressure on the screw portion side of the third check valve CV3 rises, or in a case where the spool 55 is set to the neutral position Pn, the first advancing position Pa1, and a first retarding position Pb1, as illustrated in FIGS. 13, 15, and 17, the circulation valve 71 closes the drain groove D by the elastic force of the spring 73. As a result, the backward flow from the screw portion side to the head portion side is prevented.

Fourth Check Valve

As illustrated in FIGS. 13 to 18, the fourth check valve CV4 is different from the second check valve CV2 of the first embodiment in that the fourth check valve CV4 includes the support plate 65 having an aspect in which the opening plate 57 and the supporting member 59*c* are substantially integrally formed instead of including the opening plate 57 and the supporting member 59*c*.

Figure 18:
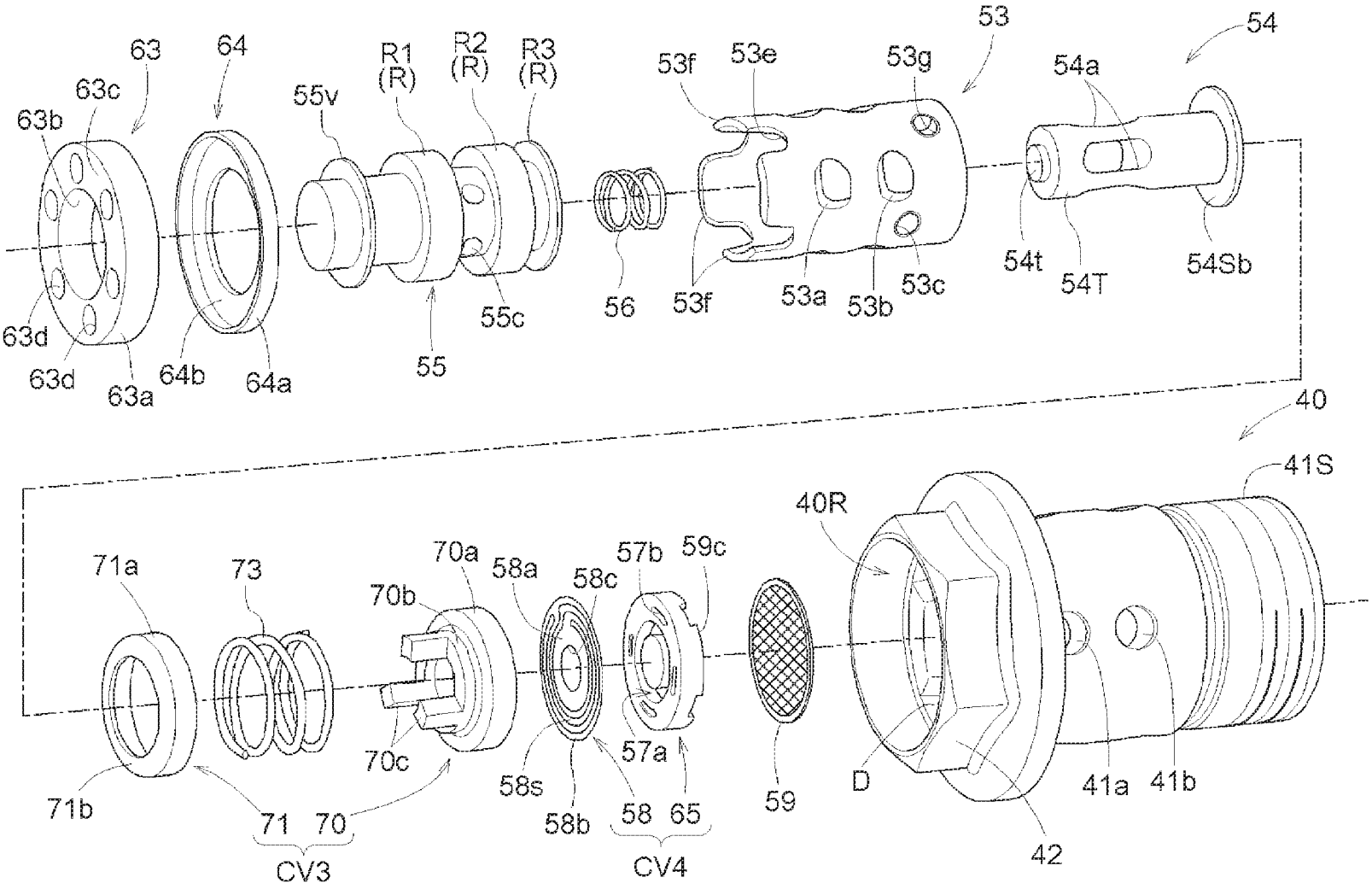
FIG. 18 is an exploded perspective view of the valve unit of the third embodiment.

As illustrated in FIG. 18, the support plate 65 is formed in an arc shape in which the pair of flow ports 57*a* are symmetrical around the rotary shaft center X, in an annular region centering around the rotary shaft center X, similar to the case of the opening plate 57. In addition, on a face (a face on the head portion side) opposing the second valve plate 58 in the support plate 65, the plurality of groove portions 57*b* which form an arc shape centering around the rotary shaft center X are formed in a region that surrounds the flow port 57*a*. On the screw portion side of the support plate 65, the supporting member 59*c* is provided in an aspect of extending in a rib shape from the outer periphery of the support plate 65 to the screw portion side.

The second valve plate 58 uses the same aspect as the second valve plate 58 (FIG. 8) of the first embodiment, but is different from the second valve plate 58 of the first embodiment in that the annular portion 58*b* is sandwiched between the outer tube portion 70*a* of the valve seat 70 and the support plate 65 and fixed in the internal space 40R. The valve body 58*a* swings back and forth on the inside of the outer tube portion 70*a* of the valve seat 70 and allows the flow of the hydraulic oil.

In the fourth check valve CV4, in a case where the pressure on the head portion side which is the downstream side of the fourth check valve CV4 rises, or in a case where the spool 55 is set in the neutral position Pn, as illustrated in FIG. 15, due to the elastic force of the spring portion 58*s*, the valve body 58*a* tightly adheres to the flow port 57*a* to close the flow port 57*a* of the support plate 65 and closes the flow port 57*a*.

Fixing of Valve Unit, First Check Valve, Second Check Valve, and Filter

First, as illustrated in FIG. 18, the filter 59 is inserted from the head portion side of the internal space 40R and abuts against the restriction wall 44. After this, the support plate 65, the second valve plate 58, the valve seat 70, the spring 73, the circulation valve 71, and the fluid supply pipe 54 are inserted into the internal space 40R in this order and abut against each other.

Furthermore, the sleeve 53 is inserted into the internal space 40R, and the end portion wall 53*w* of the sleeve 53 abuts against the intermediate wall 54Sb of the fluid supply pipe 54.

Furthermore, the spool spring 56 is inserted into the spool 55 in advance. The spool 55 in a state where the spool spring 56 inserted thereinto is fitted from the outside of the pipeline portion 54T of the fluid supply pipe 54. Accordingly, the spool 55 and the spool spring 56 are inserted into the internal space 40R.

Next, the second tip end ring 64 is fitted into the large-diameter portion 40Rb. At this time, the tip end projection portion 53*f* abuts against the screw portion side of the annular lid portion 64*b* of the second tip end ring 64.

Finally, the first tip end ring 63 is press-fitted into the large-diameter portion 40Rb toward the screw portion side. At the time of the press-fitting, the spool main body 55*a* of the spool 55 is inserted into the inner ring 63*b* of the first tip end ring 63, the tip end valve 55*v* of the spool 55 is pressed against the screw portion side end surface of the inner ring 63*b*, and the operation end portion 55*s* of the spool main body 55*a* is accommodated on the inside of the inner ring 63*b* of the first tip end ring 63 in the direction along the rotary shaft center X. In addition, against the biasing force of the spool spring 56 that biases the spool 55 toward the head portion side, the first tip end ring 63 is press-fitted into the large-diameter portion 40Rb until the second tip end ring 64 strikes the far part of the large-diameter portion 40Rb.

When the press-fitting of the first tip end ring 63 is completed, the second tip end ring 64, the spool 55, the spool spring 56, the sleeve 53, the fluid supply pipe 54, the third check valve CV3, the fourth check valve CV4, and the filter 59 are positioned in the internal space 40R from the head portion side toward the screw portion side between the first tip end ring 13 and the restriction wall 44.

Control Aspect of Hydraulic Oil

In the third embodiment, by supplying the predetermined electric power to the solenoid portion 50 of the electromagnetic unit Va, the plunger 51 protrudes, the spool 55 is moved to the screw portion side against the biasing force of the spool spring 56, and accordingly, the first advancing position Pa1, a second advancing position Pa2, the neutral position Pn, a second retarding position Pb2, and the first retarding position Pb1 can be switched in any manner as will be described later.

Advancing Position

First Advancing Position

In the valve timing controller A, in a state where no electric power is supplied to the solenoid portion 50 of the electromagnetic unit Va, no pressing force acts on the spool 55 from the plunger 51, and as illustrated in FIG. 13, the spool 55 is maintained at a position where the tip end valve 55*v* abuts against the screw portion side end surface of the inner ring 63*b* by the biasing force of the spool spring 56.

The position of the spool 55 is the first advancing position Pa1, and based on the position relation between the three land portions R and the advancing communication bore 53*a* and the retarding communication bore 53*b*, the intermediate hole portion 55*c* of the spool 55 and the advancing communication bore 53*a* communicate with each other via the space between the pair of front land portions, and the retarding communication bore 53*b* communicates with the space between the pair of rear land portions.

In the first advancing position Pa1, the tip end valve 55*v* is positioned further on the head portion side than on the annular lid portion 64*b* side. In addition, the annular lid portion 64*b* and the tip end valve 55*v* do not overlap each other in the radial direction. In other words, the space between the annular lid portion 64*b* and the tip end valve 55*v* is open. Therefore, the hydraulic oil can circulate between the annular lid portion 64*b* and the tip end valve 55*v* in the direction along the rotary shaft center X.

Accordingly, the hydraulic oil to be supplied from the hydraulic pump P is supplied from the supply port 54*a* of the fluid supply pipe 54 to the advancing chamber Ca via the intermediate hole portion 55*c* of the spool 55, the advancing communication bore 53*a*, and the advancing port 41*a*.

At the same time, the hydraulic oil in the retarding chamber Cb is discharged from the retarding port 41*b* to the space between the pair of rear land portions.

The hydraulic oil discharged into the space between the pair of rear land portions flows to the drain hole 53*c*, further flows from the drain groove D through the opening part formed with the recess portion 53*e* and the annular lid portion 64*b* and a gap between the annular lid portion 64*b* and the tip end valve 55*v*, and is discharged to the outside from the end portion on the head portion side of the connecting bolt 40. At this time, the back pressure of the hydraulic oil discharged to the space between the pair of rear land portions acts as a force for biasing the second land R2 toward the head portion side, and acts as a force for biasing the third land R3 toward the screw portion side. In other words, since the force that acts on the second land R2 and the force that acts on the third land R3 respectively act in opposite directions in the direction along the rotary shaft center X, the forces cancel each other out. Accordingly, the spool 55 is not influenced by the back pressure of the hydraulic oil discharged to the space between the pair of rear land portions. For example, there is no case where the spool 55 receives a force in the direction along the rotary shaft center X by the back pressure.

In addition, when the hydraulic oil discharged to the space between the pair of rear land portions flows to the drain hole 53*c* and is discharged to the outside from the end portion on the front side of the connecting bolt 40 via the drain groove D, the hydraulic oil and the spool spring 56 are not in direct contact with each other. Therefore, it is possible to suppress the deterioration over time in which the spool spring 56 wears due to the circulation of the hydraulic oil.

As a result of the feeding and discharging of the hydraulic oil, the relative rotation phase displaces in the advancing direction Sa.

In particular, in a case where the locking mechanism L is in the locked state, the spool 55 is set in the advancing position Pa, the hydraulic oil is supplied, and accordingly, a part of the hydraulic oil to be supplied to the advancing chamber Ca is supplied from the advancing flow passage 33 to the locking mechanism L, the lock member 25 is disengaged from the lock recess portion 23*a*, and the unlocking is also realized.

In addition, in the first advancing position Pa1, there is also a case where the hydraulic oil discharged to the space between the pair of rear land portions leaks to the space on the screw portion side of the third land R3 in the internal space 40R and the space (hereinafter, simply referred to as the screw portion side space) on the head portion side of the end portion wall 53*w*, from the gap between the outer periphery of the third land R3 and the inner periphery of the sleeve 53. However, the hydraulic oil that has leaked to the screw portion side space flows to the second drain hole 53*g* and is discharged from the end portion on the head portion side of the connecting bolt 40 to the outside via the drain groove D and the like. Therefore, the hydraulic oil that has leaked to the screw portion side space has no influence on the movement of the spool 55 at all. For example, the hydraulic oil that has leaked to the screw portion side space does not prevent the movement of the spool 55 on the screw portion side in the direction along the rotary shaft center X.

Second Advancing Position

By supplying the predetermined electric power to the solenoid portion 50 of the electromagnetic unit Va, the plunger 51 protrudes slightly more than that in a case of the first advancing position Pa1, the spool 55 is moved to the screw portion side against the biasing force of the spool spring 56, and it is possible to set the spool 55 to the second advancing position Pa2 illustrated in FIG. 14.

In the second advancing position Pa2, the annular lid portion 64*b* and the tip end valve 55*v* overlap each other in the radial direction, and the space between the annular lid portion 64*b* and the tip end valve 55*v* is closed. Therefore, the hydraulic oil cannot circulate between the annular lid portion 64*b* and the tip end valve 55*v* in the direction along the rotary shaft center X. In addition, in the second advancing position Pa2, the tip end valve 55*v* is in a state of being positioned slightly further on the head portion side than on the annular lid portion 64*b* side.

Similar to the first advancing position Pa1, even in the second advancing position Pa2, based on the position relation between the three land portions R and the advancing communication bore 53*a* and the retarding communication bore 53*b*, the intermediate hole portion 55*c* of the spool 55 and the advancing communication bore 53*a* communicate with each other via the space between the pair of front land portions, and the retarding communication bore 53*b* communicates with the space between the pair of rear land portions.

Accordingly, the hydraulic oil to be supplied from the hydraulic pump P is supplied from the supply port 54*a* of the fluid supply pipe 54 to the advancing chamber Ca via the intermediate hole portion 55*c* of the spool 55, the advancing communication bore 53*a*, and the advancing port 41*a*.

At the same time, the hydraulic oil in the retarding chamber Cb is discharged from the retarding port 41*b* to the space between the pair of rear land portions.

The hydraulic oil discharged to the space between the pair of rear land portions flows to the drain hole 53*c* and flows out to the drain groove D. The hydraulic oil that has flowed flows through the drain groove D further toward the internal space 40R on the screw portion side than on the end portion wall 53*w* side and the intermediate wall 54Sb side.

When the pressure (back pressure) of the hydraulic oil that circulates through the drain groove D is higher than the pressure of the hydraulic oil that circulates through the internal space 40R further on the screw portion side than on the end portion wall 53*w* side and the intermediate wall 54Sb side, a force that biases the circulation valve 71 to the screw portion side against the biasing force of the spring 73 is generated based on a differential pressure between the pressure of the hydraulic oil that circulates through the drain groove D and the pressure of the hydraulic oil that circulates through the internal space 40R further on the screw portion side than on the end portion wall 53*w* side and the intermediate wall 54Sb side. Accordingly, the circulation valve 71 is separated from the screw portion side of the intermediate wall 54Sb, and the drain groove D communicates with the internal space 40R further on the screw portion side than on the end portion wall 53*w* side and the intermediate wall 54Sb side. In addition, the hydraulic oil that circulates through the drain groove D is supplied to the fluid supply pipe 54 through the supply pipe opening portion 54Sa. In other words, the hydraulic oil discharged to the space between the pair of rear land portions circulates to the fluid supply pipe 54. The hydraulic oil that has circulated is supplied to the advancing chamber Ca together with the hydraulic oil to be supplied from the hydraulic pump P. By the circulation of the hydraulic oil, the hydraulic oil is quickly supplied to the advancing chamber Ca.

In addition, when the hydraulic oil discharged to the space between the pair of rear land portions flows to the drain hole 53*c* and circulates to the fluid supply pipe 54 via the drain groove D, the hydraulic oil and the spool spring 56 are not in direct contact with each other. Therefore, it is possible to suppress the deterioration over time in which the spool spring 56 wears due to the circulation of the hydraulic oil.

As a result of the feeding and discharging and the circulation of the hydraulic oil, the relative rotation phase displaces in the advancing direction Sa.

Neutral Position

By supplying the predetermined electric power to the solenoid portion 50 of the electromagnetic unit Va, the plunger 51 protrudes, and it is possible to set the spool 55 to the neutral position Pn illustrated in FIG. 15 against the biasing force of the spool spring 56.

In a case where the spool 55 is set to the neutral position Pn, the pair of land portions on the head portion side are in a position relation of closing the advancing communication bore 53*a* and the retarding communication bore 53*b* of the sleeve 53. In other words, the first land R1 closes the advancing communication bore 53*a* and the second land R2 closes the retarding communication bore 53*b*. Accordingly, the hydraulic oil is not supplied to the advancing chamber Ca and the retarding chamber Cb and the relative rotation phase is maintained.

Even in the neutral position Pn, the annular lid portion 64*b* and the tip end valve 55*v* overlap each other in the radial direction, and the space between the annular lid portion 64*b* and the tip end valve 55*v* is closed. Therefore, the hydraulic oil cannot circulate between the annular lid portion 64*b* and the tip end valve 55*v* in the direction along the rotary shaft center X. In addition, in the neutral position Pn, the tip end valve 55*v* and the annular lid portion 64*b* are at substantially the same position in the direction along the rotary shaft center X.

Retarding Position

Second Retarding Position

By supplying the electric power that exceeds the above-described predetermined electric power to the solenoid portion 50 of the electromagnetic unit Va, the plunger 51 further protrudes than that in a case of the neutral position Pn, and it is possible to set the spool 55 to the second retarding position Pb2 illustrated in FIG. 16.

In the second retarding position Pb2, based on the position relation between the three land portions R and the advancing communication bore 53*a* and the retarding communication bore 53*b*, the intermediate hole portion 55*c* of the spool 55 and the retarding communication bore 53*b* communicate with each other via the space between the pair of land portions at the front part, and the advancing communication bore 53*a* communicates with the space between the first land R1 and the tip end valve 55*v*.

In the second retarding position Pb2, the annular lid portion 64*b* and the tip end valve 55*v* overlap each other in the radial direction, and the space between the annular lid portion 64*b* and the tip end valve 55*v* is closed. Therefore, the hydraulic oil cannot circulate between the annular lid portion 64*b* and the tip end valve 55*v* in the direction along the rotary shaft center X. In addition, in the second retarding position Pb2, the tip end valve 55*v* is in a state of being positioned slightly further on the screw portion side than on the annular lid portion 64*b* side.

Accordingly, the hydraulic oil to be supplied from the hydraulic pump P is supplied from the supply port 54*a* of the fluid supply pipe 54 to the retarding chamber Cb via the intermediate hole portion 55*c* of the spool 55, the retarding communication bore 53*b*, and the retarding port 41*b*.

At the same time, the hydraulic oil in the advancing chamber Ca is discharged from the advancing port 41*a* via the advancing communication bore 53*a* to the space between the first land R1 and the tip end valve 55*v*.

The hydraulic oil discharged into the space between the first land R1 and the tip end valve 55*v* flows out to the drain groove D via the opening part formed by the recess portion 53*e* and the annular lid portion 64*b*. The hydraulic oil that has flowed flows through the drain groove D toward the internal space 40R further on the screw portion side than on the end portion wall 53*w* side and the intermediate wall 54Sb side.

When the pressure (back pressure) of the hydraulic oil that circulates through the drain groove D is higher than the pressure of the hydraulic oil that circulates through the internal space 40R further on the screw portion side than on the end portion wall 53*w* side and the intermediate wall 54Sb side, similar to a case of the second advancing position Pa2, the hydraulic oil discharged into the space between the first land R1 and the tip end valve 55*v* circulates to the fluid supply pipe 54. The hydraulic oil that has circulated is supplied to the retarding chamber Cb together with the hydraulic oil to be supplied from the hydraulic pump P. By the circulation of the hydraulic oil, the hydraulic oil is quickly supplied to the retarding chamber Cb.

First Retarding Position

By supplying the electric power that exceeds the above-described predetermined electric power to the solenoid portion 50 of the electromagnetic unit Va, the plunger 51 further protrudes than that in a case of the second retarding position Pb2, and it is possible to set the spool 55 to the first retarding position Pb1 illustrated in FIG. 17.

Similar to the case of the second retarding position Pb2, even in the first retarding position Pb1, based on the position relation between the three land portions R and the advancing communication bore 53*a* and the retarding communication bore 53*b*, the intermediate hole portion 55*c* of the spool 55 and the retarding communication bore 53*b* communicate with each other via the space between the pair of front land portions, and the advancing communication bore 53*a* communicates with the space between the first land R1 and the tip end valve 55*v*.

In the first retarding position Pb1, the tip end valve 55*v* is positioned further on the screw portion side than on the annular lid portion 64*b* side. In addition, the annular lid portion 64*b* and the tip end valve 55*v* do not overlap each other in the radial direction. In other words, the space between the annular lid portion 64*b* and the tip end valve 55*v* is open. Therefore, the hydraulic oil can circulate between the annular lid portion 64*b* and the tip end valve 55*v* in the direction along the rotary shaft center X.

Accordingly, the hydraulic oil to be supplied from the hydraulic pump P is supplied from the supply port 54*a* of the fluid supply pipe 54 to the retarding chamber Cb via the intermediate hole portion 55*c* of the spool 55, the retarding communication bore 53*b*, and the retarding port 41*b*.

At the same time, the hydraulic oil in the advancing chamber Ca is discharged from the advancing port 41*a* via the advancing communication bore 53*a* to the space between the first land R1 and the tip end valve 55*v*.

The hydraulic oil discharged to the space between the first land R1 and the tip end valve 55*v* flows through the gap between the annular lid portion 64*b* and the tip end valve 55*v* and is discharged from the end portion on the head portion side of the connecting bolt 40 to the outside. At this time, the back pressure of the hydraulic oil discharged to the space between the first land R1 and the tip end valve 55*v* acts as a force for biasing the tip end valve 55*v* toward the head portion side, and acts as a force for biasing the first land R1 toward the screw portion side. In other words, since the force that acts on the tip end valve 55*v* and the force that acts on the first land R1 respectively act in opposite directions in the direction along the rotary shaft center X, the forces cancel each other out. Therefore, the influence of the back pressure received by the spool 55 from the hydraulic oil discharged to the space between the first land R1 and the tip end valve 55*v* becomes small. For example, the force received by the spool 55 in the direction along the rotary shaft center X by the back pressure is reduced.

As a result of the feeding and discharging of the hydraulic oil, the relative rotation phase displaces in the retarding direction Sb.

Modification Example of Third Embodiment

Hereinafter, a modification example of the third embodiment of the valve timing controller according to the disclosure will be described. The embodiment will be described with reference to FIG. 21.

In the third embodiment, a case where the second valve plate 58 and the support plate 65 are used as the fourth check valve CV4, and the annular portion 58*b* of the second valve plate 58 is sandwiched between the outer tube portion 70*a* of the valve seat 70 and the support plate 65 and is fixed by internal space 40R has been described. In the embodiment, instead of using the fourth check valve CV4, a fifth check valve CV5 accommodated and mounted inside the tube of the outer tube portion 70*a* of the valve seat 70 and on the radially inner side of the support leg portion 70*c* is used. Similar to the fourth check valve CV4, the fifth check valve CV5 corresponds to the second check valve CV2 of the first embodiment.

The fifth check valve CV5 is accommodated and mounted inside the tube of the outer tube portion 70*a* of the valve seat 70 and on the radially inner side of the support leg portion 70*c*, and accordingly, the fifth check valve CV5 and the third check valve CV3 are at the same position in the direction along the rotary shaft center X, and the fifth check valve CV5 and the third check valve CV3 overlap each other in the radial direction. Therefore, compared to the valve unit Vb of the third embodiment, the valve unit Vb of the embodiment can shorten the length in the direction along the rotary shaft center X.

The fifth check valve CV5 includes a tube portion 81 in the direction along the rotary shaft center X, a spring seat 80 mounted on the head portion side of the tube portion 81, a valve seat portion 83 mounted on the head portion side of the tube portion 81, a spring 82 inserted into the inside of the tube of the tube portion 81 and supported by the spring seat 80 on the head portion side, and a ball 85 that serves as a valve body which is biased to the screw portion side by the spring 82 and tightly adheres to the valve seat portion 83.

In the fifth check valve CV5, when the hydraulic oil is supplied from the screw portion side, the ball 85 moves to the head portion side against the biasing force of the spring 82 and is separated from the valve seat portion 83, and the hydraulic oil is allowed to pass through the check valve CV5. Meanwhile, when the hydraulic oil flows backward from the head portion side, the ball 85 strongly adheres to the valve seat portion 83, and prevents the hydraulic oil from passing through the fifth check valve CV5.

Other configurations of the embodiment are similar to those of the third embodiment.

As described above, it is possible to provide a valve timing controller capable of accurately controlling the valve timing controller.

Another Embodiment (1) In the above-described embodiments (the first embodiment and the second embodiment), the configuration in which the valve unit Vb includes the first check valve CV1 and the second check valve CV2 has been described. In addition, in the above-described embodiments (the third embodiment and the modification example of the third embodiment), the configuration in which the valve unit Vb includes the third check valve CV3 and the fourth check valve CV4 or the fifth check valve CV5 has been described.

However, a configuration in which the valve unit Vb does not include the second check valve CV2 can also be employed. In addition, a configuration in which the fourth check valve CV4 and the fifth check valve CV5 are not provided can also be employed.

(2) In the above-described embodiments (the first embodiment and the second embodiment), a case where the circulation hole 54*b* that forms a part of the second check valve CV2 is formed in the intermediate wall 54Sb and the circulation hole 54*b* is disposed in an arc shape in which the pair of through ports are symmetrical around the rotary shaft center X in the annular region along the outer periphery of the pipeline portion 54T centering around the rotary shaft center X, has been exemplified. In addition, a case where the circulation hole 54*b* is two slit-like through ports formed in an arc shape has been exemplified.

However, the circulation hole 54*b* is not limited to a case of being formed in a pair, but can be formed as one or three or more through ports. In addition, the circulation hole 54*b* is not limited to two slit-like through ports formed in an arc shape, and the through ports of a plurality of round holes can also be arranged in an annular shape.

(3) In the above-described embodiments (the first embodiment and the second embodiment), a case where the drain hole 53*c* and the drain hole 53*d* share the drain groove D is exemplified.

However, the drain hole 53*c* and the drain hole 53*d* can also be configured to communicate with independent drain grooves D, respectively.

(4) In the above-described embodiments (the first embodiment and the second embodiment), a case where the drain groove D is formed in a posture along the rotary shaft center X in the region that reaches the tip end from the intermediate position at the inner periphery of the connecting bolt 40, and the tip end ring 61 has the outer tube portion 61*a* fitted in the internal space 40R, is exemplified. In this case, the hydraulic oil discharged to the outside from the drain groove D is not restricted at all.

However, in the tip end ring 61, a flow rate restricting member which restricts an opening area (a cross-sectional area of the groove) in the direction along the rotary shaft center X in the drain groove D may be provided, and the flow resistance of the hydraulic oil discharged from the drain groove D to the outside may be adjusted. There is a case where, by increasing the flow resistance of the hydraulic oil discharged from the drain groove D to the outside, it is possible to increase the amount of the hydraulic oil that has circulated from the first check valve CV1 to the fluid supply pipe 54 in the hydraulic oil to be discharged to the outside via the drain groove D.

(5) In the above-described embodiments, a case where, in the connecting bolt 40 that serves as the valve case, the bolt head portion 42 is formed in the outer end portion of the bolt main body 41 which is tubular as a whole, and the male screw portion 41S is formed at the outer periphery of the other end part from the bolt head portion 42 in the main body 41, has been described.

In addition, a case where, in a state where the bolt main body 41 of the connecting bolt 40 that serves as the valve case is inserted into the annular member 9, the external rotor 20, and the internal rotor 30, the male screw portion 41S is screwed into the female screw portion 5S of the intake cam shaft 5, and by rotating the bolt head portion 42, the internal rotor 30 (driven side rotation member) is fastened to the intake cam shaft 5, has been described.

However, the valve case does not necessarily be the connecting bolt 40 formed with the male screw portion 41S, and the fastening between the internal rotor 30 and the intake cam shaft 5 is not limited to an aspect of fastening by screwing the male screw portion 41S of the connecting bolt 40 which is the valve case and the female screw portion 5S of the intake cam shaft 5 to each other.

For example, in the valve case, the bolt head portion 42 having a front edge part that extends radially outward can be formed in the outer end portion of the bolt main body 41 which is tubular as a whole, and the main body 41 of the valve case can also be inserted into the annular member 9, the external rotor 20, and the internal rotor 30.

In this case, the connection (fastening) between the internal rotor 30 and the intake cam shaft 5 can be performed, for example, by providing the through hole in the direction along the rotary shaft center X at the front edge part of the bolt head portion 42, the annular member 9, and the internal rotor 30, by further providing the female screw portion in the direction along the rotary shaft center X at the position that corresponds to the through hole of the intake cam shaft 5, by screwing the fastening bolt (cam bolt) to female screw portion of the intake cam shaft 5 by inserting the fastening bolt into the front edge part of the bolt head portion 42, the annular member 9, and the through hole of the internal rotor 30 in order, by compressing the bolt head portion 42 of the valve case against the annular member 9, and by integrating the valve case, the annular member 9, the internal rotor main body 31, and the intake cam shaft 5. In other words, the internal rotor 30 (driven side rotation member) can also be connected to the intake cam shaft 5 by fastening bolts. The connection can be performed by using a plurality (for example, three) of fastening bolts.

(6) In the above-described embodiments, as an example of the space communication path, the drain groove D (first embodiment) provided at the inner periphery of the connecting bolt 40 and the drain path DL (second embodiment) which is a tubular flow passage provided in the spool main body 55*a* of the spool 55 are exemplified.

However, the space communication path is not limited to the aspect similar to the drain groove D or the drain path DL. For example, the thick part of the tube of the sleeve 53 described in the first embodiment can also be provided so as to penetrate in the direction along the rotary shaft center X, and similar to the case of the drain groove D, the thick part can also be a groove-like flow passage provided on the outer surface of the sleeve 53.

(7) In the above-described embodiments, a case where the advancing port 41*a* communicates with the advancing flow passage 33 and the retarding port 41*b* communicates with the retarding flow passage 34, and the like, have been described.

However, the relationship between the advancing port 41*a* and the retarding port 41*b* can be interchanged. In a case where the relationship between the advancing port 41*a* and the retarding port 41*b* is interchanged, the relationship between the advancing position Pa and the retarding position Pb in the first embodiment and the second embodiment is interchanged. In addition, in a case of the third embodiment, the first advancing position Pa1 and the first retarding position Pb1 are interchanged, and the second advancing position Pa2 and the second retarding position Pb2 are interchanged.

In addition, the configuration disclosed in the above-described embodiments (including another embodiment, the same applies hereinafter) can be applied in combination with the configuration disclosed in other embodiments as long as there is no inconsistency, and the embodiment disclosed in the specification is an example, and the embodiment of the disclosure is not limited thereto, and can be appropriately modified within a scope not departing from the object of the disclosure.

The disclosure can be applied to a valve timing controller which includes a driving side rotation member and a driven side rotation member and accommodates a valve unit in a connecting bolt that connects the driven side rotation member to a cam shaft.

A feature of a valve timing controller according to an aspect of this disclosure resides in that the valve timing controller includes: a driving side rotation member that synchronously rotates with a crankshaft of an internal combustion engine; a driven side rotation member which is disposed coaxially with a rotary shaft center of the driving side rotation member and rotates integrally with a valve opening/closing cam shaft; an advancing chamber and a retarding chamber which are formed between the driving side rotation member and the driven side rotation member; a valve unit that is disposed coaxially with the rotary shaft center and controls feeding and discharging of a fluid to and from the advancing chamber and the retarding chamber; and a tubular valve case which has an internal space that extends in a direction along the rotary shaft center, accommodates the valve unit in the internal space, has an opening that is open to an outside at one end in the direction along the rotary shaft center, and has a bottom portion at the other end, in which the valve unit includes a fluid supply pipe having a base end portion accommodated on a bottom portion side of the internal space and a pipeline portion that extends along the rotary shaft center from the base end portion toward the opening side has a diameter smaller than that of the base end portion and has a bottom surface, and a spool which is disposed slidably in the direction along the rotary shaft center in a state of being guided on an inner peripheral surface of the valve case and an outer peripheral surface of the pipeline portion of the fluid supply pipe, in which the valve case includes an advancing port and a retarding port which are formed across the internal space from the outer peripheral surface and respectively communicate with the advancing chamber and the retarding chamber, in which the spool includes a plurality of land portions formed at an outer periphery, and an intermediate hole portion that is formed in an intermediate position of a pair of adjacent land portions and capable of communicating with the advancing port or the retarding port from an inside by sliding movement of the spool, in which the fluid supply pipe includes a supply port that is provided at an outer periphery of a distal end portion of the pipeline portion and supplies the fluid from an inside to the intermediate hole portion, and receives the supply of the fluid from the other side of the base end portion to the pipeline portion, and in which the valve case has a first check valve that is provided on the bottom portion side of the valve case, and allows at least a part of the fluid discharged from the advancing chamber or the retarding chamber to a space between the valve case and the spool to flow from the space to a space further on the bottom portion side than on the base end portion side in the internal space.

According to the configuration, the spool is disposed in the internal space (hereinafter, there is a case of being referred to as an opening side internal space) on the opening side of the valve case when viewed from the base end portion of the fluid supply pipe, and the fluid discharged from the advancing chamber or the retarding chamber is discharged to the space between the valve case and the spool, that is, the internal space on the opening side of the valve case when viewed from the base end portion of the fluid supply pipe.

Further, according to the configuration, the valve case can return the fluid discharged to the space between the valve case and the spool from one of the advancing chamber and the retarding chamber to the space further on the bottom portion side than on the base end portion side in the internal space while preventing from flowing backward via the first check valve.

Here, since the fluid supply pipe receives the supply of the fluid to be supplied to the advancing chamber or the retarding chamber from the space (hereinafter, there is a case of being referred to as a bottom portion side space) on the bottom portion side of the base end portion to the pipeline portion, the fluid can be supplied to the other one of the advancing chamber and the retarding chamber by allowing the liquid discharged from one of the advancing chamber and the retarding chamber as described above to return to the bottom portion side space, that is, to circulate. Therefore, it is possible to sufficiently supply the fluid to the fluid supply pipe. As a result, it is possible to switch the valve opening/closing timing by quickly displacing the relative phase of the driven side rotation member in the advancing direction or the retarding direction.

In particular, in a case where the relative rotation phase of the driven side rotation member can be displaced in the advancing direction or the retarding direction by using the rotational energy (so-called cam torque) transmitted from the cam shaft, it is possible to displace the relative phase of the driven side rotation member in the advancing direction or the retarding direction and to switch the valve opening/closing timing while avoiding insufficient supply of the fluid.

Another feature of the valve timing controller according to the aspect of this disclosure resides in that the internal space is provided across the cam shaft from the outside, and the bottom portion is disposed on the cam shaft side.

According to the configuration, when viewed from the base end portion, the first check valve is disposed in the internal space (bottom portion side space) on the cam shaft side opposite to the internal space (opening side internal space) where the spool is disposed. Therefore, the size or the shape of the check valve is not restricted by the shape of the spool, and the structure can be simplified. Further, as described above, since the fluid discharged from the advancing chamber or the retarding chamber is discharged to the opening side internal space, by providing the first check valve on the cam shaft side in the base end portion, it is possible to allow the fluid to circulate via the opening side internal space by one check valve without using the check valve that corresponds to the advancing chamber or the retarding chamber.

Another feature of the valve timing controller according to the aspect of this disclosure resides in that the base end portion has a supply pipe opening portion for supplying the fluid from the bottom portion side toward the inside of the fluid supply pipe, and the first check valve allows the fluid that has circulated in the space further on the bottom portion side than on the base end portion side in the internal space from the space between the valve case and the spool to circulate on the inside of the fluid supply pipe through the supply pipe opening portion.

According to the configuration, the first check valve allows the fluid discharged to the opening side internal space to circulate in the bottom portion side space, and further allows the fluid that has circulated to circulate from the bottom portion side space to the inside of the fluid supply pipe via the opening portion of the base end portion of the fluid supply pipe. Accordingly, it is possible to supply the fluid to be newly supplied from the bottom portion side toward the inside of the fluid supply pipe, and to supply the fluid discharged from one of the advancing chamber and the retarding chamber to the other one of the discharging advancing chamber and the retarding chamber from which the fluid has been discharged.

Another feature of the valve timing controller according to the aspect of this disclosure resides in that the valve unit has a space communication path that allows a space between the valve case and the spool in the internal space and a space further on the bottom portion side than on the base end portion side in the internal space to communicate with each other, and the space communication path communicates with the outside of the internal space.

According to the configuration, the space communication path communicates with the opening side internal space, the bottom portion side space, and the outside of the internal space (hereinafter, referred to as an external space). Accordingly, it is possible to discharge the fluid from the opening side internal space to the external space via the space communication path. In addition, it also becomes possible to allow the fluid to circulate from the opening side internal space to the bottom portion side space via the space communication path and the first check valve.

Another feature of the valve timing controller according to the aspect of this disclosure resides in that the spool has a valve body for switching a state where the internal space and the outside communicate with each other and a state where the internal space and the outside do not communicate with each other by the sliding movement of the spool, in a distal end portion on the opening side.

According to the configuration, it is possible to switch the state where the fluid can be discharged from the opening side internal space to the external space via the space communication path and the state where the discharge of the fluid from the opening side internal space to the external space via the space communication path is not allowed, by the sliding movement of the spool. In addition, in a state where the discharge of the fluid from the opening side internal space to the external space via the space communication path is not allowed, it becomes possible to promote the circulation of the fluid from the opening side internal space to the bottom portion side space via the space communication path and the first check valve.

Another feature of the valve timing controller according to the aspect of this disclosure resides in that the valve timing controller further includes a second check valve for allowing the fluid to flow from the bottom portion side toward the fluid supply pipe, and the second check valve is disposed further on the bottom portion side than the first check valve in the internal space.

According to the configuration, it is possible to prevent the fluid that is discharged from the advancing chamber or the retarding chamber and has passed through the first check valve from flowing backward to the upstream side (the bottom portion side when viewed from the second check valve), or to prevent the fluid supplied to the pipeline portion of the fluid supply pipe from flowing backward to the upstream side (the bottom portion side when viewed from the second check valve).

A feature of a valve timing controller according to another aspect of this disclosure resides in that the valve timing controller includes: a driving side rotation member that synchronously rotates with a crankshaft of an internal combustion engine; a driven side rotation member which is disposed coaxially with a rotary shaft center of the driving side rotation member and rotates integrally with a valve opening/closing cam shaft; an advancing chamber and a retarding chamber which are formed between the driving side rotation member and the driven side rotation member; a valve unit that is disposed coaxially with the rotary shaft center and controls feeding and discharging of a fluid to and from the advancing chamber and the retarding chamber; and a valve case in which an internal space is formed in a direction along the rotary shaft center across the cam shaft from an outside, in which the valve unit is accommodated in the internal space, in which the valve unit includes a fluid supply pipe having a base end portion fitted into a cam shaft side in the internal space and a pipeline portion that extends from the base end portion toward an external side in the internal space and has a diameter smaller than that of the base end portion, and a spool which is disposed slidably in a direction along the rotary shaft center in a state of being guided on an inner peripheral surface of the valve case and an outer peripheral surface of the pipeline portion of the fluid supply pipe, in which the valve case includes an advancing port and a retarding port which are formed across the internal space from the outer peripheral surface and respectively communicate with the advancing chamber and the retarding chamber, in which the spool includes a pair of land portions formed at an outer periphery, and an intermediate hole portion that is formed in an intermediate position of a pair of land portions and capable of communicating with the advancing port or the retarding port from an inside by sliding movement of the spool, in which the fluid supply pipe receives the supply of the fluid from the cam shaft side of the base end portion to the pipeline portion, and in which the fluid supply pipe includes a supply port that is provided at an outer periphery of a distal end portion of the pipeline portion and supplies the liquid from an inside to the intermediate hole portion, and a first check valve that is provided in the base end portion and allows at least a part of the fluid discharged from the advancing chamber or the retarding chamber to a space between the valve case and the spool to flow from the external side of the base end portion to the cam shaft side.

According to the configuration, the spool is disposed in the internal space (hereinafter, there is a case of being referred to as an external side internal space) on the external side of the valve case when viewed from the base end portion of the fluid supply pipe, and the fluid discharged from the advancing chamber or the retarding chamber is discharged to the space between the valve case and the spool, that is, the internal space on the external side of the valve case when viewed from the base end portion of the fluid supply pipe.

Further, according to the configuration, in the base end portion of the fluid supply pipe, the first check valve that allows the fluid to flow from the external side to the cam shaft side, that is, the first check valve that allows the fluid to circulate from the external side to the cam shaft side and blocks the circulation of the fluid from the cam shaft side to the external side, is provided. Accordingly, it is possible to return the fluid discharged from one of the advancing chamber and the retarding chamber to the cam shaft side of the internal space of the valve case when viewed from the base end portion while preventing the fluid from flowing backward via the first check valve provided in the base end portion.

Here, since the fluid supply pipe receives the supply of the fluid to be supplied to the advancing chamber or the retarding chamber from the space (hereinafter, there is a case of being referred to as a cam shaft side space) on the cam shaft side of the base end portion to the pipeline portion, the fluid can be supplied to the other one of the advancing chamber and the retarding chamber by allowing the liquid discharged from one of the advancing chamber and the retarding chamber as described above to return to the cam shaft side of the valve case when viewed from the base end portion, that is, to circulate. Therefore, it is possible to sufficiently supply the fluid to the fluid supply pipe. As a result, it is possible to switch the valve opening/closing timing by quickly displacing the relative phase of the driven side rotation member in the advancing direction or the retarding direction.

In particular, in a case where the relative rotation phase of the driven side rotation member can be displaced in the advancing direction or the retarding direction by using the rotational energy (so-called cam torque) transmitted from the cam shaft, it is possible to quickly displace the relative phase of the driven side rotation member in the advancing direction or the retarding direction and to switch the valve opening/closing timing while avoiding insufficient supply of the fluid.

Another feature of the valve timing controller according to the aspect of this disclosure resides in that the first check valve is provided on the cam shaft side of the base end portion.

According to the configuration, when viewed from the base end portion, the first check valve is disposed in the internal space on the cam shaft side opposite to the internal space where the spool is disposed. Therefore, the size or the shape of the check valve is not restricted by the shape of the spool, and the structure can be simplified. Further, as described above, since the fluid discharged from the advancing chamber or the retarding chamber is discharged to the external side internal space, by providing the first check valve on the cam shaft side in the base end portion, it is possible to allow the fluid to circulate via the external side internal space by one check valve without using the check valve that corresponds to each of the advancing chamber or the retarding chamber.

Another feature of the valve timing controller according to the aspect of this disclosure resides in that the base end portion has a base end portion partition wall that partitions the external side and the cam shaft side in the internal space, the base end portion partition wall has a circulation hole for allowing the external side and the cam shaft side to communicate with each other, the circulation hole is provided along an outer periphery of the pipeline portion, and the first check valve has an annular valve plate that closes the circulation hole.

According to the configuration, the internal space is partitioned by the base end portion into the external side space and the cam shaft side space on the other side of the external side space with the base end portion partition wall therebetween.

Further, according to the configuration, since the base end portion partition wall is provided along the outer periphery of the pipeline portion, the circulation hole is provided along the outer periphery of the pipeline portion. Accordingly, the opening part of the circulation hole is disposed, for example, in an annular shape, or is formed as a slit-like opening that forms an annular shape or a part of an arc.

Therefore, the first check valve has an annular shape, that is, an opening that corresponds to the pipeline portion, and it is possible to realize the circulation of the fluid while preventing the fluid from flowing backward in an annular valve plate having a simple shape formed in a shape of a plate that closes the circulation hole.

Another feature of the valve timing controller according to the aspect of this disclosure, a second check valve which allows the fluid to flow from the cam shaft side toward the fluid supply pipe is further provided.

According to the configuration, the fluid discharged from the advancing chamber or the retarding chamber, it is possible to prevent the fluid that has passed through the first check valve from flowing backward to the upstream side, or to prevent the fluid supplied to the pipeline portion of the fluid supply pipe from flowing backward to the upstream side.

Another feature of the valve timing controller according to the aspect according to the aspect of this disclosure resides in that the valve unit has a space communication path that communicates with both a space further on the cam shaft side than on the pair of land portions side and a space on the external side, in the internal space, and the space communication path communicates with the outside of the internal space.

According to the configuration, since the space communication path communicates with both the space on the cam shaft side in the internal space and the space on the external side in the internal space and further communicates with the outside of the internal space, it is possible to allow the space on the cam shaft side in the internal space and the space on the external side in the internal space to communicate with the outside of the internal space via the space communication path.

Accordingly, it becomes possible to exchange the fluid between the two spaces, and even in a case where the fluid discharged from the advancing chamber or the retarding chamber was discharged to either the space on the cam shaft side of the pair of land portions or the space on the external side, it is possible to supply the fluid for the circulation.

According to the configuration, it is possible to further discharge the fluid discharged into the valve unit and the space between the valve casing and the spool, that is, the fluid that was not supplied for the circulation, to the outside via the space communication path.

Another feature of the valve timing controller according to the aspect of this disclosure resides in that the valve timing controller further includes a sleeve provided on an inner peripheral surface of the internal space, the sleeve has an advancing communication bore that communicates with the advance port from an inner side and a retarding communication bore that communicates with the retarding port from the inside, the spool is guided on an inner peripheral surface of the valve case via an inner peripheral surface of the sleeve, and the intermediate hole portion communicates with the advancing port via the advancing communication bore and communicates with the retarding port via the retarding communication bore, and the space communication path is formed between the valve case and the sleeve.

According to the configuration, it is possible to form a space communication path between the valve case and the sleeve. In addition, the space communication path can communicate with both the space on the cam shaft side in the internal space and the space on the external side in the internal space. Furthermore, while communicating with the outside of the internal space, it is possible to allow the space on the cam shaft side in the internal space and the space on the external side in the internal space to communicate with the outside of the internal space via the space communication path.

Another feature of the valve timing controller according to the aspect of this disclosure resides in that the valve timing controller further includes a connecting bolt which is disposed coaxially with the rotary shaft center and connects the driven side rotation member to the cam shaft by a screw portion as the valve case, and the internal space is formed to penetrate the valve case from the screw portion of the connecting bolt toward a head portion.

According to the configuration, it is possible to compactly form the valve timing controller by using the connecting bolt that connects the driven side rotation member to the cam shaft as the valve case.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve timing controller comprising:

a driving side rotation member that synchronously rotates with a crankshaft of an internal combustion engine;

a driven side rotation member which is disposed coaxially with a rotary shaft center of the driving side rotation member and rotates integrally with a valve opening/closing cam shaft;

an advancing chamber and a retarding chamber which are formed between the driving side rotation member and the driven side rotation member;

a valve unit that is disposed coaxially with the rotary shaft center and controls feeding and discharging of a fluid to and from the advancing chamber and the retarding chamber; and a tubular valve case which has an internal space that extends in a direction along the rotary shaft center, accommodates the valve unit in the internal space, has an opening that is open to an outside at one end in the direction along the rotary shaft center, and has a bottom portion at an other end, wherein the valve unit includes a fluid supply pipe having a base end portion accommodated on a bottom portion side of the valve case, and a pipeline portion, wherein the pipeline portion extends along the rotary shaft center from the base end portion toward an opening side of the valve case, has a diameter smaller than a diameter of the base end portion, and has a bottom surface, and a spool which is disposed slidably in the direction along the rotary shaft center in a state of being guided on an inner peripheral surface of the valve case and an outer peripheral surface of the pipeline portion of the fluid supply pipe, the valve case includes an advancing port and a retarding port which are formed across the internal space from the outer peripheral surface and respectively communicate with the advancing chamber and the retarding chamber, the spool includes a plurality of land portions formed at an outer periphery of the spool, and an intermediate hole portion that is formed in an intermediate position of a pair of adjacent land portions of the plurality of land portions and configured to communicate with the advancing port or the retarding port from an inside of the spool by a sliding movement of the spool, the fluid supply pipe includes a supply port that is provided at an outer periphery of a distal end portion of the pipeline portion and is configured to supply the fluid from an inside of the fluid supply pipe to the intermediate hole portion, and to receive the supply of the fluid from a side of the base end portion opposite the pipeline portion to the pipeline portion, and the valve case has a first check valve that is provided on the bottom portion side of the valve case, and is configured to allow at least a part of the fluid discharged from the advancing chamber or the retarding chamber to a space between the valve case and the spool to flow from the space to a space further on the bottom portion side than on the base end portion side in the internal space.

2. The valve timing controller according to claim 1, wherein the internal space is provided across the cam shaft from the outside, and the bottom portion is disposed on a cam shaft side.

3. The valve timing controller according to claim 1, wherein the base end portion has a supply pipe opening portion configured to supply the fluid from the bottom portion side toward the inside of the fluid supply pipe, and the first check valve is configured to allow the fluid that has circulated in the space further on the bottom portion side than on the base end portion side in the internal space from the space between the valve case and the spool to circulate on the inside of the fluid supply pipe through the supply pipe opening portion.

4. The valve timing controller according to claim 1, wherein the valve unit has a space communication path that allows the space between the valve case and the spool and the space further on the bottom portion side than on the base end portion side in the internal space to communicate with each other, and the space communication path communicates with the outside of the internal space.

5. The valve timing controller according to claim 1, wherein the spool has a valve body configured to switch between a state where the internal space and the outside communicate with each other and a state where the internal space and the outside do not communicate with each other by the sliding movement of the spool, in a distal end portion on the opening side.

6. The valve timing controller according to claim 1, further comprising:

a second check valve configured to allow the fluid to flow from the bottom portion side toward the fluid supply pipe, wherein the second check valve is disposed further on the bottom portion side than the first check valve in the internal space.

7. The valve timing controller according to claim 1, further comprising:

a connecting bolt which is disposed coaxially with the rotary shaft center and connects the driven side rotation member to the cam shaft by a screw portion, which serves as the valve case, wherein the internal space is formed to penetrate the valve case from the screw portion of the connecting bolt toward a head portion.

8. A valve timing controller comprising:

a driving side rotation member that synchronously rotates with a crankshaft of an internal combustion engine;

a driven side rotation member which is disposed coaxially with a rotary shaft center of the driving side rotation member and rotates integrally with a valve opening/closing cam shaft;

an advancing chamber and a retarding chamber which are formed between the driving side rotation member and the driven side rotation member;

a valve unit that is disposed coaxially with the rotary shaft center and controls feeding and discharging of a fluid to and from the advancing chamber and the retarding chamber; and a valve case in which an internal space is formed in a direction along the rotary shaft center across the cam shaft from an outside, wherein the valve unit is accommodated in the internal space, the valve unit includes a fluid supply pipe having a base end portion fitted into a cam shaft side in the internal space, and a pipeline portion that extends from the base end portion toward an external side in the internal space and has a diameter smaller than a diameter of the base end portion, and a spool which is disposed slidably in a direction along the rotary shaft center in a state of being guided on an inner peripheral surface of the valve case and an outer peripheral surface of the pipeline portion of the fluid supply pipe, the valve case includes an advancing port and a retarding port which are formed across the internal space from the outer peripheral surface and respectively communicate with the advancing chamber and the retarding chamber, the spool includes a pair of land portions formed at an outer periphery of the spool, and an intermediate hole portion that is formed in an intermediate position of the pair of land portions and configured to communicate with the advancing port or the retarding port from an inside of the spool by a sliding movement of the spool, the fluid supply pipe is configured to receive a supply of the fluid from a cam shaft side of the base end portion to the pipeline portion, and the fluid supply pipe includes a supply port that is provided at an outer periphery of a distal end portion of the pipeline portion and is configured to supply the fluid from an inside of the fluid supply pipe to the intermediate hole portion, and a first check valve that is provided in the base end portion and is configured to allow at least a part of the fluid discharged from the advancing chamber or the retarding chamber to a space between the valve case and the spool to flow from an external side of the base end portion to the cam shaft side.

9. The valve timing controller according to claim 8, wherein the first check valve is provided on the cam shaft side of the base end portion.

10. The valve timing controller according to claim 9, wherein the base end portion has a base end portion partition wall that partitions the external side and the cam shaft side in the internal space, the base end portion partition wall has a circulation hole configured to allow the external side and the cam shaft side to communicate with each other, the circulation hole is provided along an outer periphery of the pipeline portion, and the first check valve has an annular valve plate that closes the circulation hole.

11. The valve timing controller according to claim 8, wherein the valve unit has a space communication path that communicates with both a space further on the cam shaft side than on a pair of land portions side and a space on the external side, in the internal space, and the space communication path communicates with an outside of the internal space.

12. The valve timing controller according to claim 11, further comprising:

a sleeve provided on an inner peripheral surface of the internal space, wherein the sleeve has an advancing communication bore that communicates with the advance port from an inside of the sleeve and a retarding communication bore that communicates with the retarding port from the inside of the sleeve, the spool is guided on the inner peripheral surface of the valve case via an inner peripheral surface of the sleeve, and the intermediate hole portion communicates with the advancing port via the advancing communication bore and communicates with the retarding port via the retarding communication bore, and the space communication path is formed between the valve case and the sleeve.

13. The valve timing controller according to claim 8, further comprising:

a second check valve which is configured to allow the fluid to flow from the cam shaft side toward the fluid supply pipe.

14. The valve timing controller according to claim 8, further comprising:

a connecting bolt which is disposed coaxially with the rotary shaft center and connects the driven side rotation member to the cam shaft by a screw portion, which serves as the valve case, wherein the internal space is formed to penetrate the valve case from the screw portion of the connecting bolt toward a head portion.

* * * * *